United States Patent [19]

Yamamoto et al.

[11] 3,999,480

[45] Dec. 28, 1976

[54] APPARATUS FOR EFFECTING SECONDARY PRINTING IN THE COURSE OF PAPER DELIVERY IN ADDITION TO PRIMARY PRINTING ACHIEVED WITHIN THE BODY OF AN OFFSET PRINTING MACHINE

[75] Inventors: Masahiro Yamamoto, Kawanishi; Kazuyuki Hatsuda, Takatsuki, both of Japan

[73] Assignee: Hamada Printing Press Mfg. Co., Ltd., Osaka, Japan

[22] Filed: Nov. 5, 1975

[21] Appl. No.: 629,108

[52] U.S. Cl. ..... 101/177; 101/183; 101/232; 271/215; 271/217

[51] Int. Cl.[2] ..... B41F 5/16

[58] Field of Search ..... 101/232, 248, 183, 177, 101/179, 184, 136–137, 141–142, 152–153, 174–175, 216–218, 233–238, 240–241; 271/226–228, 213–214, 215, 217

[56] References Cited

UNITED STATES PATENTS

| | | | |
|---|---|---|---|
| 969,418 | 9/1910 | Staude | 101/183 |
| 2,156,032 | 4/1939 | Seybold | 271/217 |
| 2,163,492 | 6/1939 | Kelly | 271/217 X |
| 2,598,414 | 5/1952 | Morse | 101/177 |
| 2,940,387 | 6/1960 | Pritchard | 101/183 |
| 3,008,710 | 11/1961 | Blaha | 271/215 |
| 3,153,535 | 10/1964 | Gericke | 101/232 X |
| 3,283,710 | 11/1966 | Zahradnik et al. | 101/248 |
| 3,285,607 | 11/1966 | Lindemann | 271/217 X |
| 3,570,398 | 3/1971 | Mowry | 101/183 X |
| 3,667,385 | 6/1972 | Suzuki | 101/232 |
| 3,835,776 | 9/1974 | Weidman | 101/248 X |
| 3,847,079 | 11/1974 | Dahlgren | 101/232 X |
| 3,848,320 | 11/1974 | Davidson, Jr. | 101/177 X |
| 3,913,478 | 10/1975 | Terzuolo et al. | 101/232 |

FOREIGN PATENTS OR APPLICATIONS

| | | | |
|---|---|---|---|
| 610,164 | 12/1960 | Canada | 101/179 |
| 235,046 | 11/1944 | Switzerland | 101/183 |
| 289,392 | 3/1953 | Switzerland | 101/183 |
| 220,221 | 3/1966 | U.S.S.R. | 101/183 |

*Primary Examiner*—E. H. Eickholt

[57] ABSTRACT

An apparatus for effecting secondary printing in the course of paper delivery in addition to primary printing achieved within the body of an offset printing machine comprises a delivery mechanism, a mechanism provided with a printing couple for performing secondary printing, a mechanism for applying printing pressure and a mechanism for arranging paper sheets.

17 Claims, 29 Drawing Figures

246
247
212
248
231
234
220
240
235
214
253
611
617
613
262
213
614
263
255
257
261
224
225
226
101
220
212
240
643
645
646
642
656
641

APPARATUS FOR EFFECTING SECONDARY PRINTING IN THE COURSE OF PAPER DELIVERY IN ADDITION TO PRIMARY PRINTING ACHIEVED WITHIN THE BODY OF AN OFFSET PRINTING MACHINE

The present invention relates to an apparatus adapted to be fitted to an offset printing machine and to effect secondary printing such as numbering and spot printing in the course of paper delivery.

In general, there are offset printing machines of the type of effecting secondary printing e.g. number printing in which the secondary printing apparatus is provided within the body of the offset printing machine.

Since the conventional secondary printing apparatus is not adapted to be fitted only to a printing machine, a printing machine not provided with such an apparatus therein cannot be used for secondary printing.

Further, a conventional secondary printing apparatus e.g. a number of printing apparatus has a disadvantage that a numbering ring and an impression cylinder are located always at a predetermined distance and they have been in contact with each other before the material to be printed is conveyed thereto, so that numerals are printed on the impression cylinder and the printed numerals are in turn transferred onto the back surface of the material fed in the early time. In order to eliminate the said disadvantage, the impression cylinder and the numbering ring need to be not fixedly arranged with respect to each other but adapted to come into contact with each other only at need. In this case, since a certain time is required from the time when the top of the material to be printed (which is paper in the following description) enters the printing machine to the time when it reaches the numbering ring of a numbering unit, a delay means for number change is necessary. Namely, if a numbering unit is being operated to change number from the time when the paper enters the printing machine, there is a lag and the number is not correctly printed. Therefore, after the number is printed on the predetermined paper, by exchanging the number change unit, the exchanged number is to be printed on the succeeding paper. And the reverse is applied in the last printing. Namely, if the numbering unit stops immediately after the last paper passes the unit, the said last paper is not numbered. Therefore, the numbering unit is to be continuously operated till the last paper is numbered. In the conventional method, a delay means for delaying the operation of number exchange unit is an electric or mechanical one, but it is much complicated, very expensive and easy to break. Therefore, according to the present invention, such disadvantages are eliminated and improvement is performed in inking, delivery and paper arranging mechanisms.

A main object of the present invention is to provide an apparatus which is adapted to be removably attached to the exit side of an offset printing machine for primary printing and to perform secondary printing while delivering papers after primary printing.

Another object of the present invention is to provide an apparatus in which an impression cylinder of a printing couple for secondary printing is releasable and adjustable with respect to printing pressure thereof so that the cylinder can operate with a fixed time of delay with respect to the operation of the impression cylinder for primary printing.

A further object of the present invention is to provide an apparatus by which serial numbers are printed on the primarily printed papers, in which a secondary printing couple comprises a numbering ring and an impression cylinder and a number exchange cam for the numbering ring and a release mechanism for said cam.

A further object of the present invention is to provide an apparatus in which an inking mechanism supplying ink to a printing couple for secondary printing is adapted to be removably fitted to a frame of secondary printing unit so that the inking mechanism can retreat from the supply position.

A further object of the present invention is to provide an apparatus in which a secondary printing couple comprises a spot printing cylinder and an impression cylinder so as to effect spot printing on the primarily printed papers.

A further object of the present invention is to provide an apparatus in which a delivery mechanism comprises a transferring mechanism driven by power obtained from a primary printing impression cylinder and a lowering mechanism driven by power obtained from a secondary printing impression cylinder, so that the said papers are surely delivered while being secondarily printed.

A further object of the present invention is to provide an apparatus in which a paper arranging mechanism for arranging papers delivered on a delivery table by the delivery mechanism comprises a longitudinally arranging mechanism and a laterally arranging mechanism both of which are driven by power obtained by the rotation of the secondary printing impression cylinder.

A further object of the present invention is to provide an apparatus in which a secondary printing couple and a transferring mechanism of a delivery mechanism are driven by means of a gear provided on a driving sprocket wheel shaft for the transfer mechanism, the said gear being in engagement with a gear provided on an impression cylinder of a primary printing couple, and an inking mechanism is driven through the rotation of a master cylinder shaft of a secondary printing couple while a lowering mechanism of the delivery mechanism and a paper arranging mechanism are driven by the power obtained from an impression cylinder of the secondary printing couple.

Other objects and features of the invention will be apparent from the ensuing description to be driven with reference to the accompanying drawings, in which.

Figure 1:
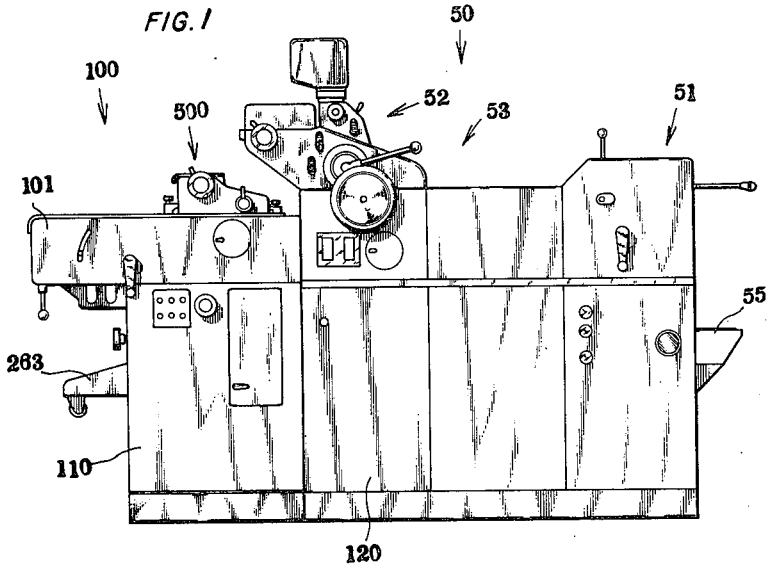
FIG. 1 is a front view of an offset printing machine shown in its entirety with the present apparatus attached thereto.
Figure 4:
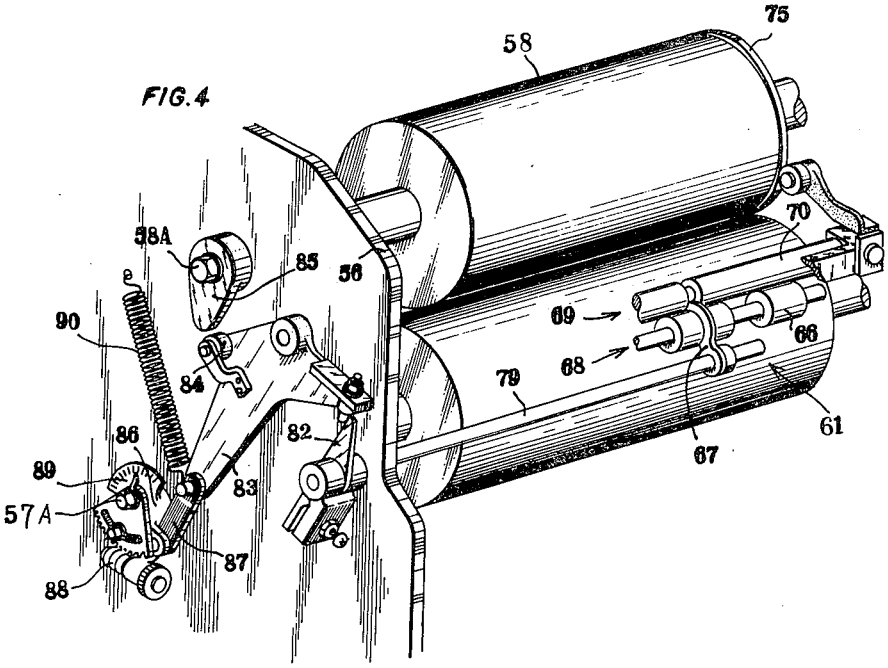
FIG. 4 is a perspective view showing the internal construction of the paper detecting mechanism.

FIG. 1 is a front view of an offset printing machine 50 having attached thereto a secondary printing apparatus 100 constructed according to the present invention. The offset printing machine 50 may be known one, comprising a paper feeding unit 51 adapted to forwardly feed sheets of paper one by one from a paper table 55 carrying a number of sheets of paper and adapted to be elevated, a plate cylinder having a sheet-form original plate mounted thereon, a blanket cylinder rotatable in contact with the plate cylinder, an impression cylinder mounted on an eccentric shaft, a mechanism for detecting the arrival of paper, an inking device 52, and a printing unit 53, the arrangement being such that a sheet of paper being fed from the paper feeding unit actuates said paper detecting mechanism to rotate the eccentric shaft for urging the impression cylinder against the blanket cylinder to provide an impression necessary for the printing unit to print the sheet.

Besides the components described above, some offset printing machines include a unit for automatically mounting an original plate on the plate cylinder, a unit for ejecting the original plate from the plate cylinder, a unit for etching an original plate, and a unit for drying ink after the latter is printed. In such type of printing machine also, the offset printing couple is located at the rearmost end thereof, and it is possible to attach the present apparatus thereto for carrying out secondary printing.

Generally, the offset printing machine 50 is equipped with two motors, one designated at 51 for the paper feeding unit, the other 53 for the printing unit, and the inking device 52 is adapted to be powered by the printing unit 53. The reason for the employment of this arrangement is that the smaller the number of motors used, the less the cost involved. Further, since the operations of the individual mechanisms in the unit are associated with each other, the transmission of motion of a single motor to the mechanisms makes it easier to provide the necessary synchronism and timing for the mechanisms.

For these reasons, the present apparatus is not provided with any motor and instead it is arranged so that it may receive power from the primary printing couple in the offset printing machine 50.

Figure 2:
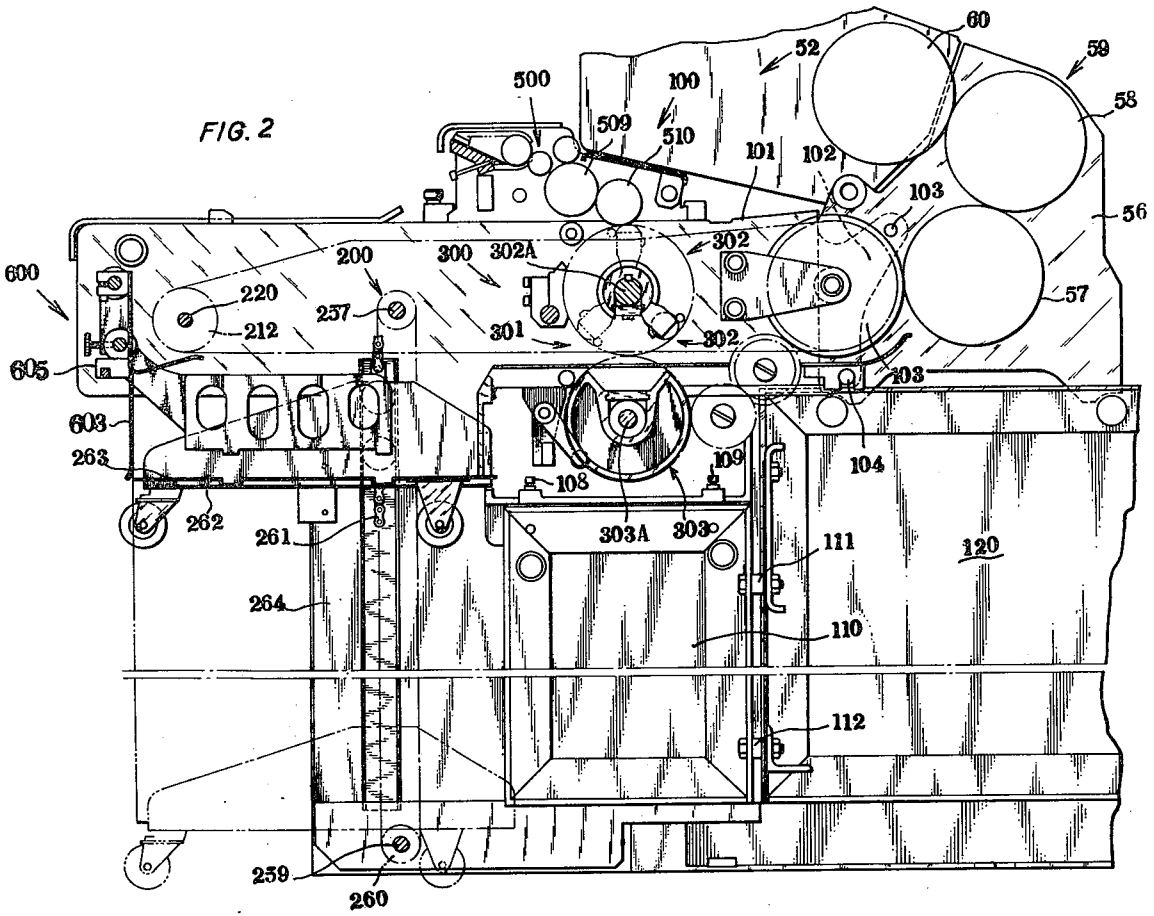
FIG. 2 is a sectional view showing the principal internal mechanisms of the present apparatus.
Figure 6:
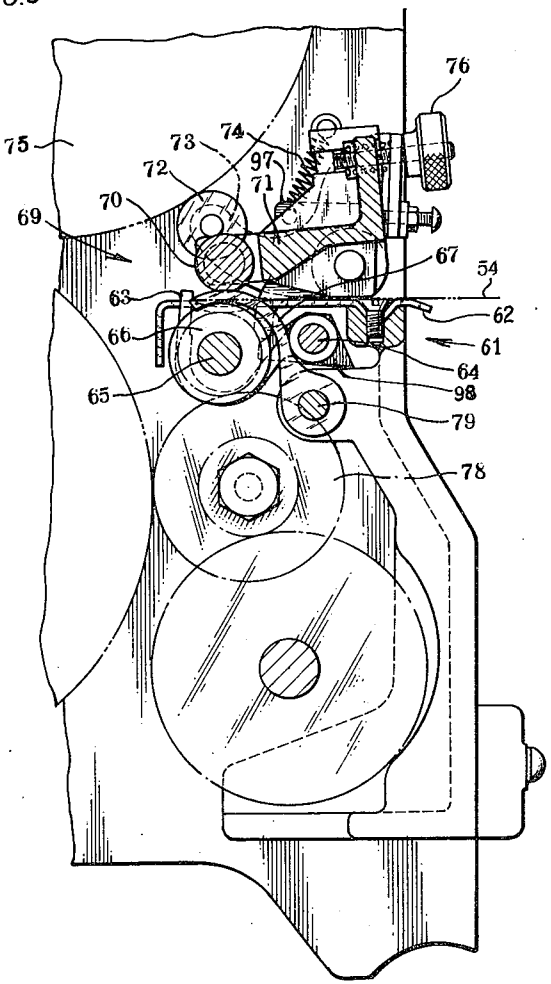
FIG. 6 is a front sectional view of the paper detecting mechanism.
Figure 3:
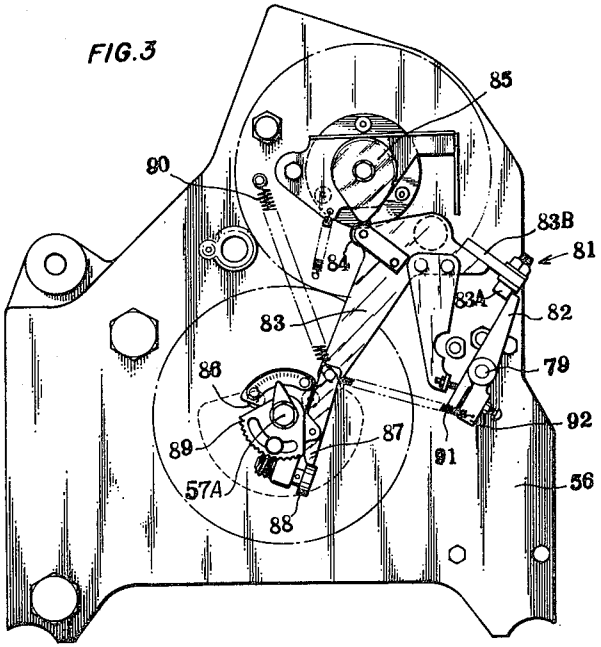
FIG. 3 is a front view showing the relationship between a primary printing couple and a paper detecting mechanism.
Figure 5:
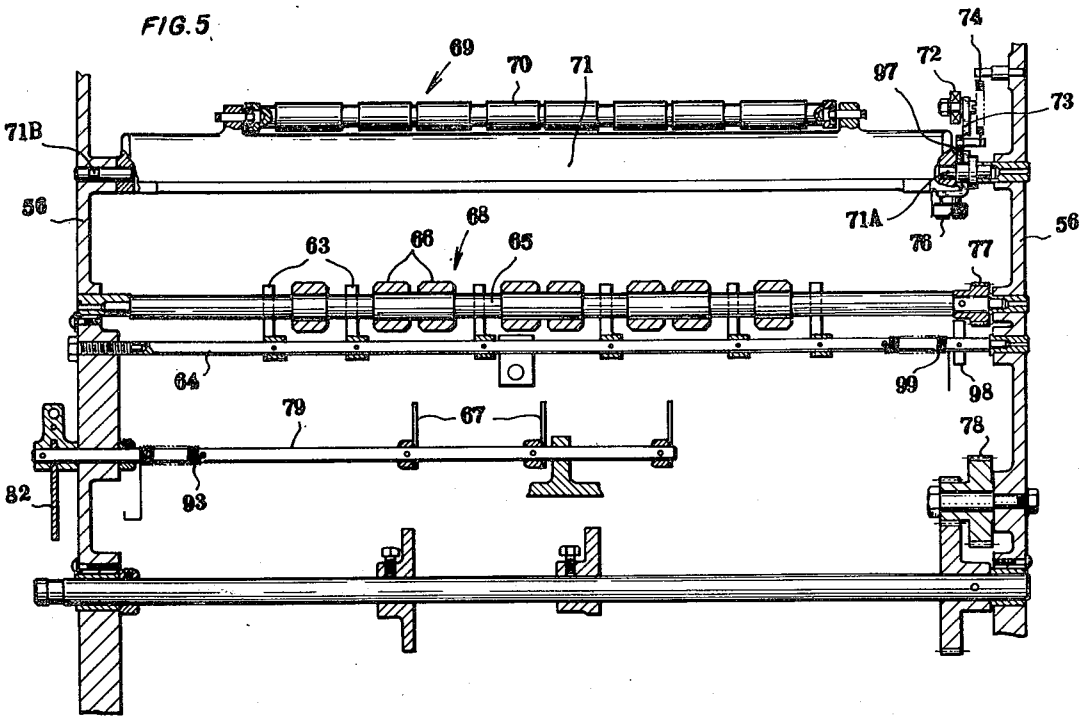
FIG. 5 is a detailed developed view showing the internal construction of the paper detecting mechanism.

FIG. 2 shows the entire internal construction of the apparatus 100 for carrying out secondary printing according to the present invention, said apparatus comprising a delivery mechanism 200, a mechanism 300 having a printing couple 301 for secondary printing, a linking mechanism 400 (shown in FIG. 7) for imparting an impression to the secondary printing couple, a mechanism 500 for feeding ink, and a paper attitude correcting mechanism 600.

The principal mechanisms of the present apparatus 100 are suitably supported by a delivery frame 101 which is secured to a base box 110 through adjusting bolts 108 and 109 in such a manner that its level is adjustable. The base box 110 has a base cover panel 264 supporting part of the delivery mechanism 200 and cooperates with said frame 101 to define the external shape of the present apparatus 100. When it is desired to attach the present apparatus 100 to the offset printing machine 50, the frame 101 is attached to the frame 56 supporting the primary printing couple 59 while the base box 110 is attached to the base box 120 of the printing machine 50. The entrance portion 102 of the frame 101, i.e., the portion to be connected to the frame 56, will be connected to the latter through bolts 103 and 104 adjacent the outer side of the frame 56. The base boxes 110 and 120 are connected together through bolts 111 and 112.

The numeral 57 designates an impression cylinder, which cooperates with a blanket cylinder 58 to constitute a printing couple for primary printing. The blanket cylinder 58 is in contact with a plate cylinder 60 to which ink is applied by the inking device 52.

FIGS. 3 through 6 show paper detecting means 61 for actuating the primary printing couple 59 to be ready for primary printing and they also show impression means 81. By the action of these two means, the impression mechanism 400 of the present apparatus imparts an impression to the impression cylinder of the secondary couple 301.

The paper detecting means 61 serves to detect the arrival of paper at a position a little short of the primary printing couple 59 and emit a signal for applying an impression to each of the impression cylinders of the primary and secondary printing couples.

Paper 54 being fed from the paper feeding unit 51 is guided onto a scaled guide plate 62. The paper thus fed is once brought to a stop by a purality of U-shaped stoppers 63. The stoppers 63 are mounted on a shaft 64 and the rotation of the latter brings them below the level of the scaled guide plate 62 to cancel the stoppage of the paper. A plurality of lower feed rollers 66 are mounted on a shaft 65 to form a lower feed roller assembly 68, said lower feed rollers being positioned to project slightly above the level of said scaled guide plate 62. Disposed between those rollers 66 are said stoppers and sheet detector fingers 67.

Disposed above said lower feed roller assembly 68 is an upper feed roller assembly 69 with upper feed rollers 70 rotatably supported by an elevating frame 71, which is pivotally supported at both ends thereof by the primary printing frame 56 through pivot pins 71A and 71B. Loosely fitted over the pivot pin 71A is a cam roll lever 73 having a cam follower 72 at the front end thereof. Fixed on said pivot pin 71A adjacent the cam roll lever is a headstop operating lever 97 for freeing the paper stoppers 63, said headstop operating lever being pulled by a spring 74 so as to be upwardly swingable. Said cam roll lever 73 and headstop operating lever 97 are arranged to have a torque transmitted thereto through an adjusting nut 76. The pull exerted by the spring 74 serves to urge the cam follower 72 against a cam 75 provided on the blanket cylinder 58, while the swing motion of the cam roll lever caused by the cam 75 through the can follower 72 results in the upper feed rollers 70 being brought into abutment against the lower feed rollers 66.

The lower end of the headstop operating lever 97 abuts against a triangular cam 98 provide at the end of the stopper shaft 64, so that simultaneously with the actuation of the upper feed roller assembly 69, the stopper shaft is rotated to lower the paper from the position where it is stopped, thereby canceling the stoppage of the paper. The numeral 99 designates a spring whereby the paper stoppers 63 lowered by the headstop operating lever 97 are brought to their original position to stop paper.

The included angle between the roll lever 73 and the elevating frame 71 can be adjusted by turning the adjusting nut 76. The adjustment of the nut 76 makes it possible to adjust the time when the paper is delivered by the lower feed rollers 66 and upper feed rollers 70. More particularly, with a larger included angle between the cam roll lever 73 and the elevating frame 71, as soon as the cam follower 72 is depressed by the cam 75, the upper feed rollers 70 are brought into contact with the lower feed rollers to deliver the paper, while if said included angle is smaller, this delays the time of contact between the upper and lower feed rollers and hence the time of delivery of paper.

The power for said lower feed roller shaft 65 is transmitted thereto in that a gear 77 provided at the end of said shaft is driven by the impression cylinder 57 through an idler gear 78.

The sheet detector finger 67 is in the form of an arcuate member provided on a sheet detector shaft 79 rotatably supported by the frame 56, the arrangement being such that when the upper feed rollers 70 are lowered to be urged against the lower feed rollers 66, the paper resting on the scaled guide plate will depress the sheet detector finger 67. The downward swing of the sheet detector finger 67 is used as a paper detection signal, actuating the impression means 81 to swing its impression lever 83, thereby actuating the mechanism for secondary printing.

The end of the sheet detector shaft 79 projecting outwardly of the frame 56 is provided with a detent pawl 82 whose front end is engageable with an adjustable latch 83A provided on a plate 83B fixed to one end of the impression lever 83.

The impression lever 83 is rotatably supported by the frame 56 and provided at its intermediate portion with an impression cam follower 84, the front end of said lever being connected to the impression cylinder 57. The shaft 58A of the blanket cylinder 58 is provided with an impression cam 85, which abuts against the cam follower 84 to swing the impression lever 83.

An impression adjustment bracket 86 loosely fitted over an eccentric shaft 57A supporting the impression cylinder 57 is connected to the front end of the impression lever 83 through an impression drive pawl 87 and rotatably supports an adjustment worm 88 meshing with an adjacent sector 89 adapted to be rotated together with the eccentric shaft 57A.

The swing motion of the impression lever 83 is converted into the rotation of the eccentric shaft 57A through the impression drive pawl 87, worm 88 and sector 89. The rotation of the eccentric shaft 57A brings the impression cylinder 57 closer to the blanket cylinder 58 to be ready for imparting the necessary impression for printing the paper.

The rotation of adjustment worm 88 changes the direction of displacement of the eccentric shaft 57A, thereby making it possible to adjust the magnitude of the impression provided by the impression cylinder.

The numeral 90 designates a spring which urges the impression can follower 84 against the impression cam 85 and pulls the impression lever 83 toward the direction in which no impression is given to the impression cylinder. Further, a spring designated at 91 is disposed between the impression lever 83 and the pin 92 of the detent pawl 82 and cooperates with a spring 93 provided on the sheet detector shaft 79 to retract the detent pawl 81 from the adjustable latch 83A and project the sheet detector finger to a position where it contacts the paper.

When the paper has not yet come between the feed roller assemblies 68 and 69, the front end of the detent pawl 82 only contacts the plate 83B of the impression lever 83 and even if the lever 83 is swung by the cam 85, it will not come into contact with the adjustable latch 83A. As a result, the lever 83 only swings under the action of the cam 85 and, though rotating the eccentric shaft 57A, it is not capable of holding the impression cylinder 57 in impressed condition.

When the paper comes between the feed roller assemblies 68 and 69, the sheet detector finger 68 is depressed and the front end of the detent pawl 82 presses the plate 83A against the force of the spring 91 and 93. As the cam 85 continues rotating until it swings the impression lever 83, the detent pawl 82 abuts against the adjustable latch 83A to hold the impression lever in impressed condition, whereby the impression cylinder 57 is held in impressed condition. Such impressed condition lasts until no paper is present between the feed roller assemblies and the impression lever is re-swung to cause the cancellation of the abutting condition of the detent pawl.

The secondary printing couple 301 is disposed intermediate between the ends of the transfer mechanism 201 and serves for making a secondary print on the paper a predetermined period of time after the primary printing couple 59 has made a primary print thereon. Delay means 401 is provided between the two printing couples in order that the action of the primary printing couple may be transmitted to the secondary printing couple only when the paper printed by the primary printing couple 59 approaches the secondary printing couple 301.

Figure 7:
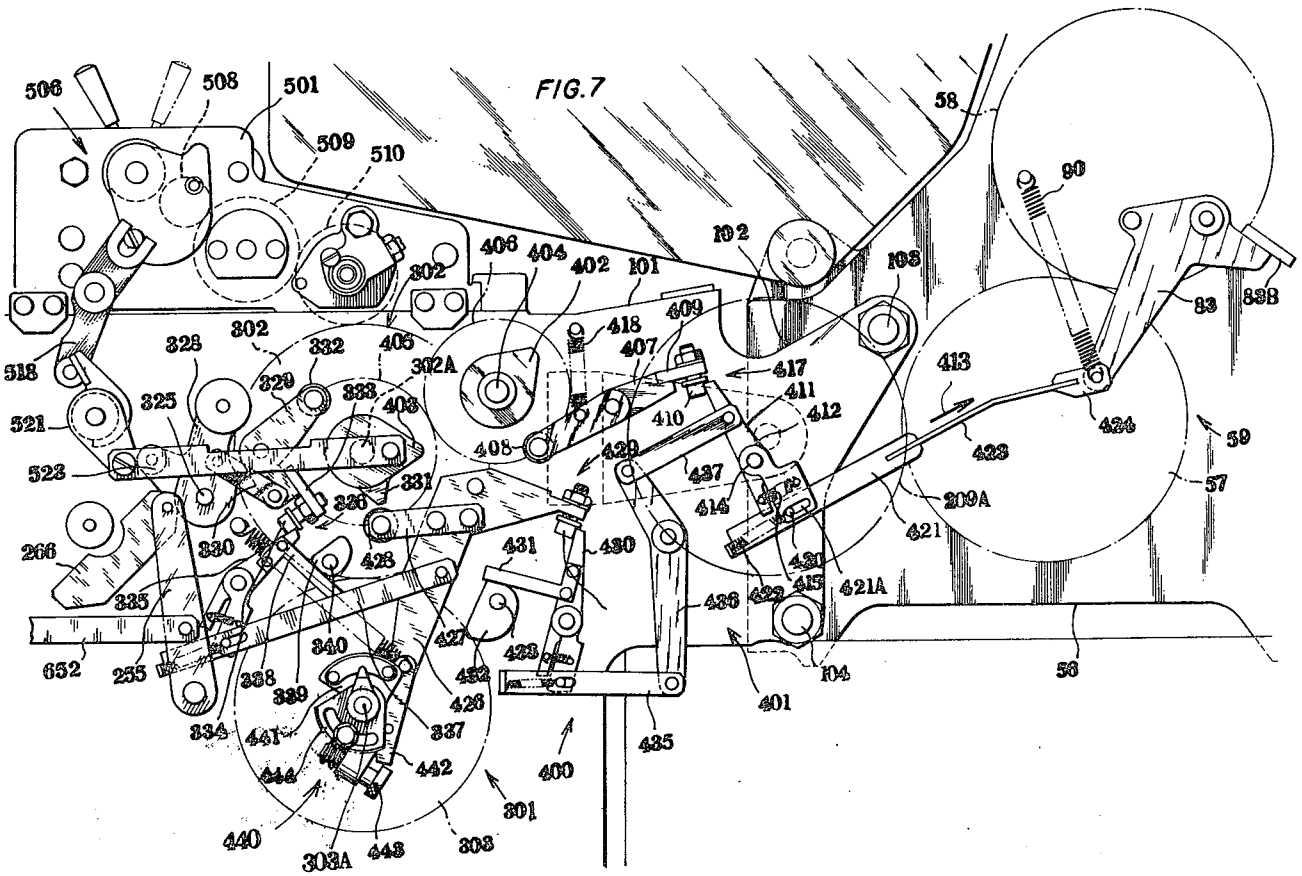
FIG. 7 is a front view showing an impression mechanism and an inking mechanism.
Figure 8:
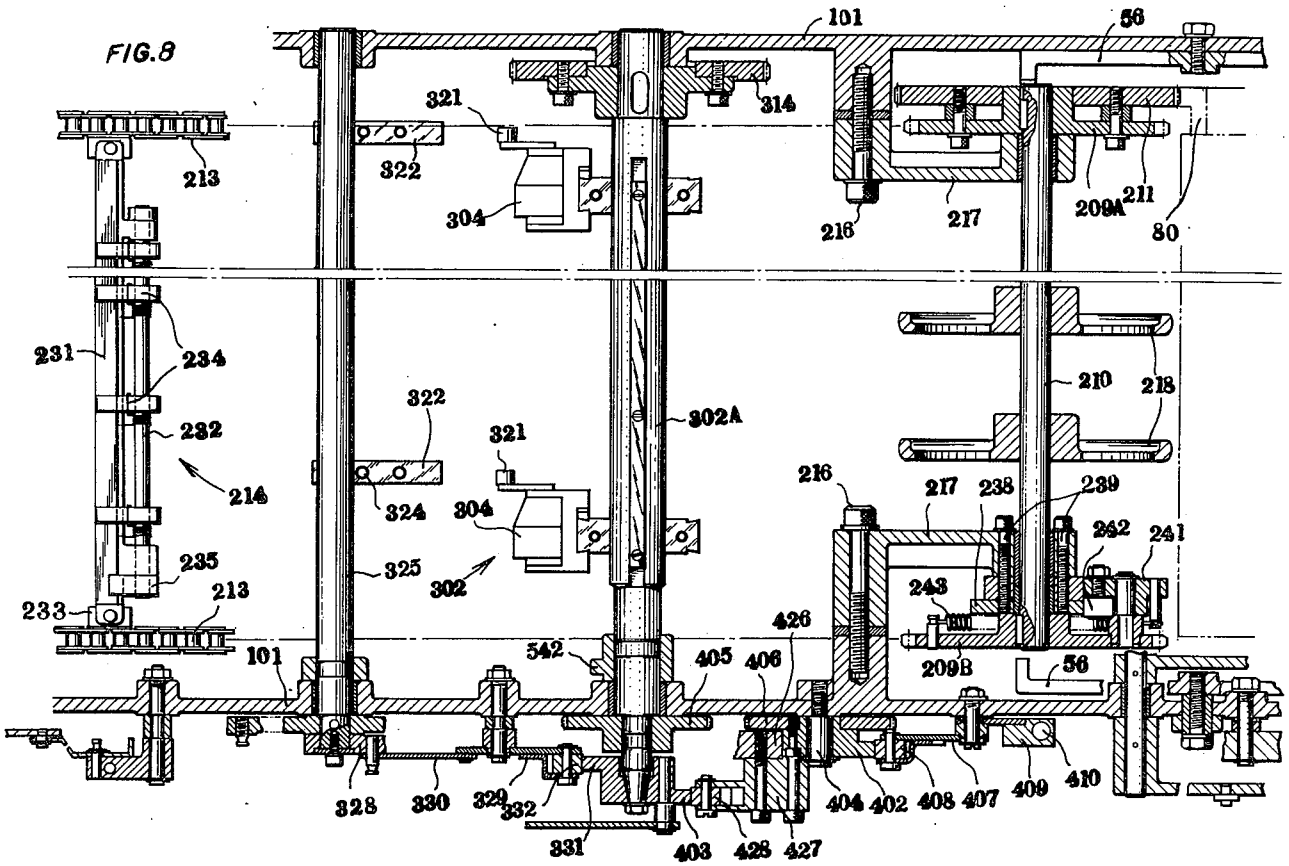
FIG. 8 is a detailed developed view showing a numbering mechanism and part of a delivery mechanism.

The delay means 401 is shown in FIGS. 7 and 8 and consists of two parts. A first part is actuated by a first delay cam 402 and a second part by a second delay cam 403. The second delay cam 403 is mounted on the shaft 302A of the master cylinder 302 of the secondary printing couple 301, while the first delay cam 402 is mounted at the shaft 404. The shafts 302A and 404 are provided with gears 405 and 406, respectively, meshing with each other, so that the rotation of the shaft 302A is transmitted to the gear 406 to rotate the cam 402.

The first delay cam 402 is engaged by a cam follower 408 mounted at one end of a drive lever 407 having a plate 409 fixed at the other end thereof, said plate being provided with an adjustable latch 410. The drive lever 407 is pivotally supported by the frame 101, and the front end of a detent pawl 411 is in contact with the plate 409 or adjustable latch 410.

The detent pawl 411 includes a detent pawl bracket 412 rotatably supported by a pin 414 set on the frame 101, said bracket being pulled by a spring 415. The detent pawl 411, plate 409 and adjustable latch 410 constitute a detent assembly 417.

The drive lever 407 is pulled by a spring 418 so that the cam follower 408 may contact the cam 402. Thus, as the cam 402 is rotated, the drive lever swings and is held in the swung condition by the detent pawl 411. The detent pawl is normally in contact with the plate 409 when impression is on position at the first printing couple so that the levers 421 and 423 are moved in direction of 413, the front end of the detent pawl is urged against the plate 409 by the spring 415, so that when the drive lever is swung in this condition, the front end of the detent pawl abuts against the adjustable latch 410, keeping the drive lever from returning under the action of the spring 418.

The bracket 412 of the detent pawl 411 has a pin 420 set therein which is inserted in an elongated opening 421A in a tension link 421. A spring 422 is installed between the pin 420 and one end of the tension link 421.

The tension link 421 is connected to the end of the impression lever 83 through links 423 and 424, so that when the impression lever 83 is swung to give an impression to the impression cylinder 57, the detent assembly 417 is actuated.

Abutting against the second delay cam 403 is a cam follower 428 mounted at the front end of a plate 427 mounted on an impression lever 426 which is adapted to give an impression to the impression cylinder 303 of the secondary printing couple 301. The impression lever 426 is swung by the rotation of the cam 403, and it is a detent assembly 429 that holds the impression lever in the swung condition, i.e., a condition in which it impresses the impression cylinder 303.

The construction of the detent assembly 429 is substantially the same as that of the detent assembly 417 except that a detent pawl 430 is provided with a fixed plate 431.

The fixed plate 431 abuts against a release cam 432 mounted on the shaft 433 rotatably supported by the frame 101, so that the rotation or the shaft 433 causes the release cam to push up the fixed plate 431. As a result, the detent 430 is retracted to a position where it will not abut against an adjustable latch 434 provided on the impression lever 426. In other words, the detent assembly is released without actuation and no impression is given to the impression cylinder 303.

Such release means is actuated where an offset printing machine equipped with the present apparatus effects only primary printing without secondary printing, and the release means allows paper to simply pass through the secondary printing couple with no impression.

One end of a tension link 435 connected to the detent pawl 430 is connected to a bell crank 436 through a pivot, while the other end of the bell crank 436 is pivotally connected to the detent pawl 411 through a link 437.

With this arrangement, the actuation of the detent pawl 411 renders the detent pawl 430 actuatable, so that the latter will be actuated when the impression lever 426 is swung.

The impression cylinder 303 of the secondary printing couple 301 will be operated as delayed by the delay means 401 a length of time extending from the time the impression cylinder 57 is actuated to the time the paper to have a secondary print made thereon completes its travel through the path. This operation is also effected when the paper detecting means 61 detects the absence of paper, and in this case the impression cylinder 303 will be operated in response to a signal commanding the application of no impression. As soon as the primary printing is started as the impression cylinder 83 is swung, the swing motion of the impression cylinder is transmitted to the detent assembly 417. It is not until the first delay cam 402 is rotated to such an extent as to swing the drive lever 407 keep the position that the detent assembly 417 is actuated and the swing motion of the detent pawl 411 is transmitted to the detent assembly 429. Thereafter, the second delay cam 403 is rotated to such an extent as to swing the impression lever 426, whereupon an impression is given to the impression cylinder 303 for secondary printing and at the same time the detent assembly 429 is actuated to hold the impression lever 426 in impressing condition whereby secondary printing is effected by the secondary printing couple 301.

As described above, the delay mechanism for actuating the impression lever 426 a given period of time after the actuation of the impression lever 83 is mechanically constructed, the operation is reliable with a minimum of trouble, and it is possible to adjust the amount of delay of time by changing the phase of the cam.

The relationship between the impression lever 426 and the impression cylinder 303 is substantially the same as the relationship between the impression lever 83 and the impression cylinder 57 and there is provided means 440 for adjusting the impression on the impression cylinder 303.

As impression adjustment bracket 441 loosely fitted over the eccentric shaft 303A supporting the impression cylinder 303 is connected to the front end of the impression lever 426 through an impression drive pawl 442 and rotatably supports an adjustment worm 443 meshing with an adjustment sector 444 which rotates together with the eccentric shaft 303A.

The swing motion of the impression lever 426 is converted into the rotation of the eccentric shaft 303A through the impression drive pawl 442, worm 443 and sector 444, and the rotation of the eccentric shaft 303A causes the impression cylinder 303 to approach the blanket cylinder 302, making ready for giving an impression necessary for printing the paper.

The adjustment worm 443, when turned, changes the direction in which the eccentric shaft is displaced, whereby the magnitude of the impression on the impression cylinder can be adjusted.

The members which constitute the secondary printing couple to the mechanism 300 vary according to the object of the secondary printing. Thus, when the numbering is to be effected, the master cylinder 302 will be provided with a numbering arrangement. Similarly, for spot printing, it will be provided with an original plate used for letter-press. Further, when slitting and/or perforating is to be effected at the same time as such secondary printing, members necessary therefor will be mounted on the master cylinder shaft 302A.

Figure 9:
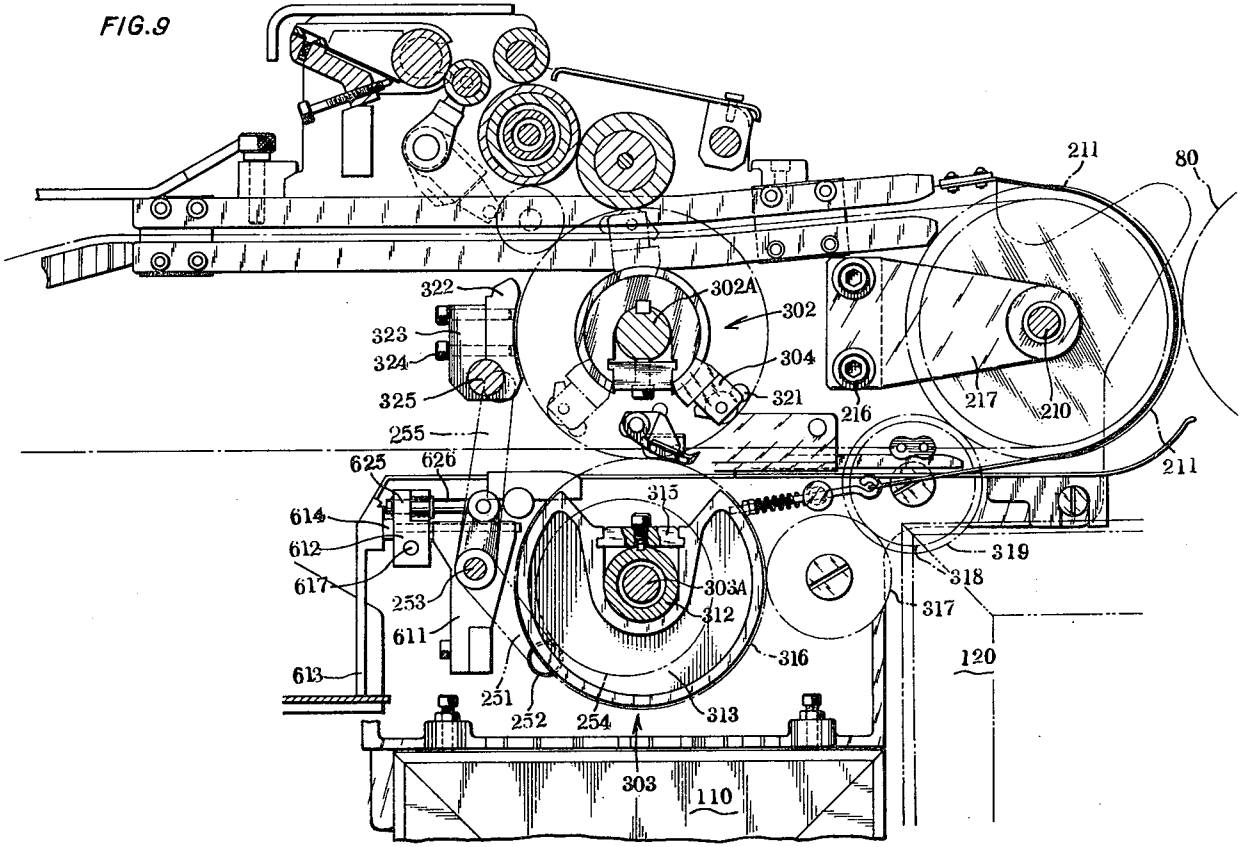
FIG. 9 is a front view with the frame removed to show a secondary printing couple, part of the delivery mechanism and part of a longitudinal paper attitude correcting mechanism.
Figure 10A:
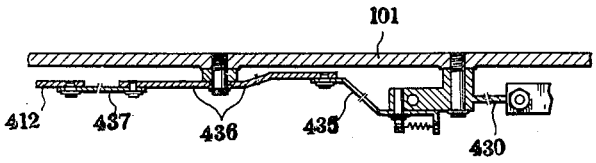
FIG. 10A is a developed explanatory view showing an example of the relationship between a detent pawl and a bell crank.
Figure 10B:
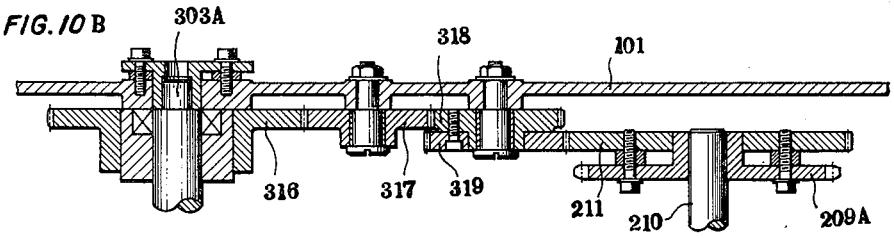
FIG. 10B is a developed explanatory view showing a gearing system for driving an impression cylinder.
Figure 11:
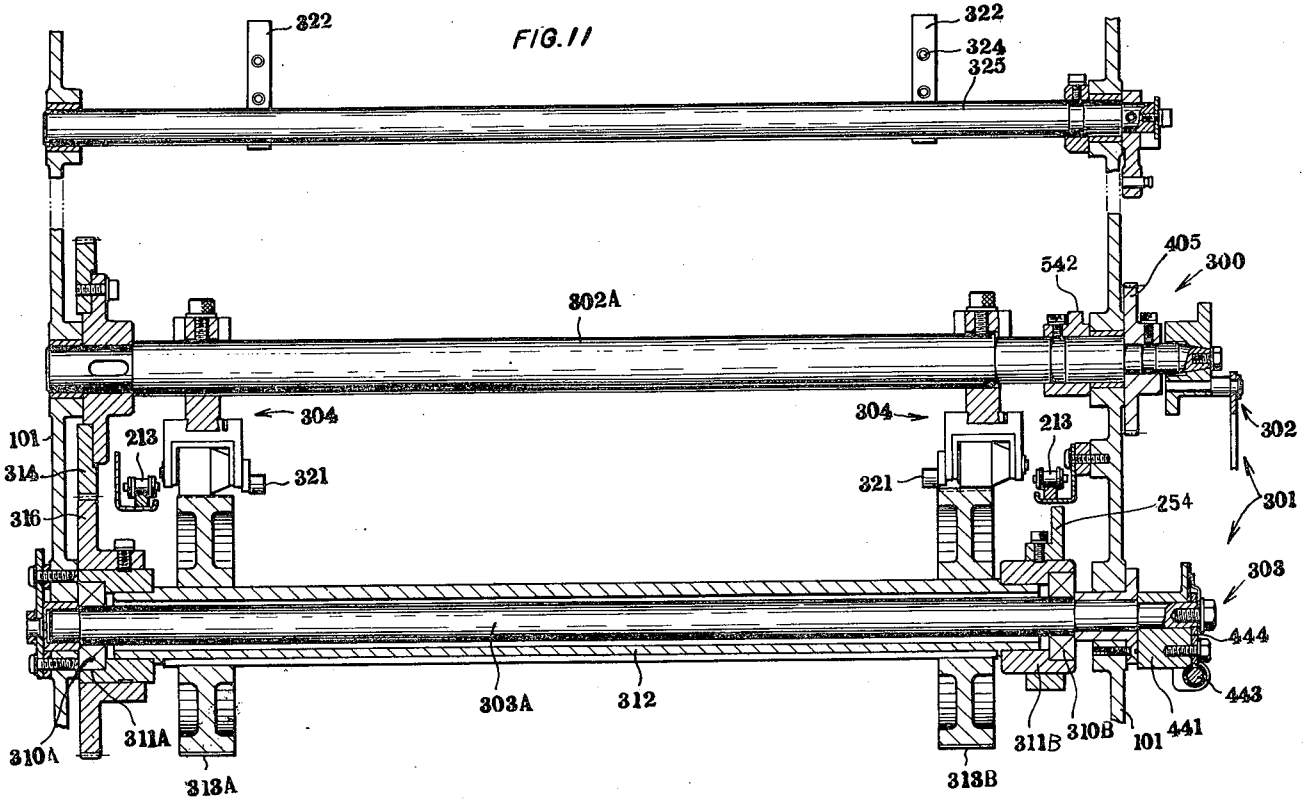
FIG. 11 is a detailed developed view to be used for explanation of a secondary printing couple provided with a numbering arrangement.

FIGS. 9 and 11 show the shaft 302A provided with numbering arrangements 304 to constitute secondary printing couples adapted for numbering.

The eccentric shaft 303A is provided with bearing holders 311A and 311B outside bearings 310A and 310B and there is supported a cylindrical shaft 312 between said bearing holders, said cylindrical shaft being disposed so as not to be in contact with the shaft 303A.

There are two impression members 313A and 313B (which, in a narrow sense, are impression cylinders) provided on the cylindrical shaft 312. The number of impression members is made equal to the number of numbering arrangements and the impression members are opposed to the numbering arrangements. In order to set the axial length of the impression member 313 at a minimum value necessary for giving impressions to the numbering arrangements, as many impression members as the numbering arrangements must be provided, but if such impression member is constructed to have substantially the same length as that of the cylindrical shaft, then a single impression member will suffice no matter how many numbering arrangements are provided or where they are positioned.

Each impression member 313 has a partly removed or notched circumferential surface of about 280° coated with rubber. Designated at 315 is a member for fixing the impression member fitted over the cylindrical shaft 312 to the latter shaft.

The bearing holder 311A has a gear 316 fixed thereto meshing with a gear 314 provided on the shaft 302A. Further, the gear 316, as shown in FIG. 9, is adapted to have powder transmitted thereto from a gear 211 mounted on the front sprocket shaft 210 of the delivery mechanism 200 via idler gears 317, 318 and 319.

The numbering arrangements 304, which are known, are detachably mounted on the shaft 302A, the angular range of attachment thereof being about 280° extending from the solid line position to the phantom line position in FIG. 9, which enables them to abut against the circmferential surfaces of the impression members 313.

It is a number change can 322 that actuates a number change lever 321 for making a change of number in a numbering arrangement 304, said number change cam being fixed to a shaft 325 by a member 323 and bolts 324. The shaft 325 is rotatably supported by the frame 101 and has a crank 328 to one end thereof projecting from the frame, said crank being connected through a link 330 to a bell crank 329 rotatably supported on the frame 101.

A cam 331 is integral with the second delay cam mounted on the shaft 302A, these two cams being out of phase with each other in their axial and circumferential positions. A cam follower 332 at one end of the bell crank 329 abuts against the cam 331, so that it swings as said cam is rotated.

One end of the bell crank 329 is provided with a plate 333 and an adjustable latch 334, which together with a detent pawl 335 constitute a detent assembly 336. The detent pawl 335 is connected to an impression lever 426 through a tension link 337. The connecting constructions for the detent assembly 336, detent pawl 335 and tension link 337 are the same as those for the detent assembly 417, detent pawl 411 and link 421.

The detent pawl 335 is provided with a fixed plate 338 abutting against a release cam 339, which is provided on a shaft 340 rotatably supported by the frame 101, so that the rotation of the shaft 340 causes the fixed plate 338 to retract the detent pawl 335 from the adjustable latch 334, thereby opening the detent assembly 336.

The construction starting with the number change cam 322 and ending in the tension link 337 constitutes a mechanism for actuating the number change lever 321. When the paper approaches the secondary printing couple 301 to actuate the impression lever 426 to give an impression to the impression cylinder 303, the detent assembly 336 becomes actuatable. As the cam 331 is rotated to such an extent as to swing the bell crank 329, the detent assembly 336 is actuated to hold the crank in the swung condition. Simultaneously therewith, the swing motion of the bell rank 329 is transmitted to the shaft 325 through the crank 328, whereby the number change cam 322, which has been retracted up to now, is advanced to a position where it abuts against the number change lever, with the result that after a secondary print is made on the paper, a change of number is made in the numbering arrangement 304. In this way, a series of numbers can be securely printed on sheets of paper after the latter are offset-printed.

Figure 12:
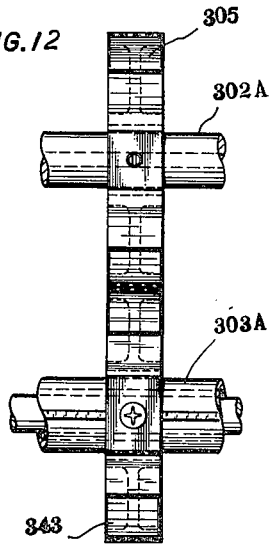
FIG. 12 is a side view showing a secondary printing couple provided with a master cylinder for spot printing.
Figure 19:
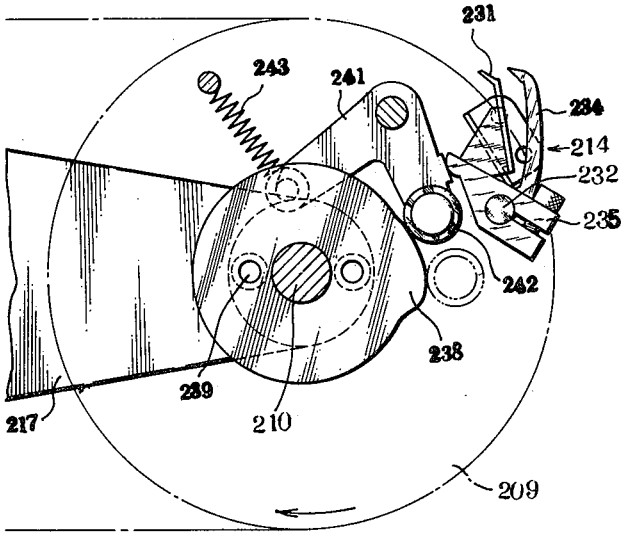
FIG. 19 is an explanatory view showing a paper receiving can for opening and closing grip means.

In the case of not effecting numbering or number change, the shaft 340 is rotated to open tbe detent assembly 336 so as not to transmit the swing motion of the impression lever 426 to the detent pawl 335. In this case also, the bell crank 329 does not keep swung position by the rotation of the cam 331 and hence the number change cam 322 is also swung, but it only moves to and without coming into contact with the number change lever 321, In the case of effecting spot printing other than numbering by means of secondary printing couple, as shown in FIG. 12, the shaft 302A of the master cylinder 302 is provided with a plate cylinder 305 having mounted thereon an original plate for letterpoint while an impression member 343 of substantially the same axial length as that of the cylinder 305 is mounted on the shaft 303A.

The impression member 343 has the same construction as the previously described impression member 313 and an impression member used for numbering may be applied for this purpose provided that it has the same axial length as that of the cylinder 305, i.e., a sufficient length to give an impression to the original plate for spot printing. The cylinder having the original plate mounted thereon is a known one.

With the present apparatus, numbering and spot printing can be effected and the exchange of numbering arrangements and plate cylinders is very simple.

It is possible to arrange the mechanism 300 so that slitting or perforating is effected simultaneously with secondary printing.

Figure 13:
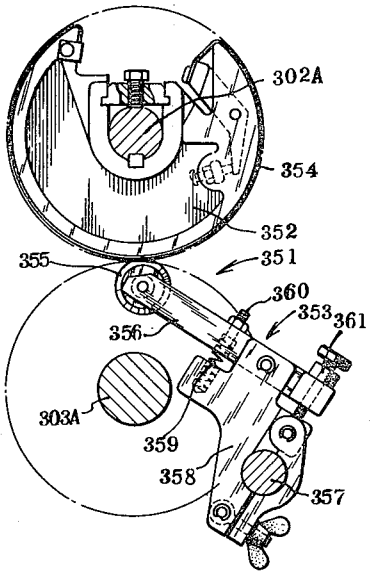
FIG. 13 is a front sectional view of a secondary printing couple provided with a slitter couple.
Figure 14:
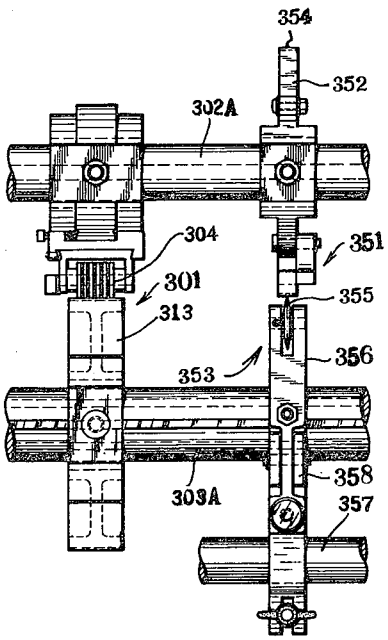
FIG. 14 is a side view of the secondary printing couple provided with a slitter couple.

FIGS. 13 and 14 show slitter means 351 provided in the secondary printing couple 301 for slitting.

The slitter means 351 consists of a slitting roller 352 provided on the master cylinder shaft 302A, and a slitting assembly 353. The slitting roller 352 has a slitting anvil 354 of metal plate mounted thereon. The outer diameter of the slitting roller 352 is slightly smaller than the printing circle of the numbering arrangement and it such that it does not contact a form roller 510 which feeds ink to the numbering arrangement 304.

Disposed below the slitting roller is a slitter 355 which contacts the slitting roller 352 for slitting paper therebetween. An arm 356 rotatably supporting the slitter 355 is pivotally supported by a support member 358 mounted on a shaft 357. A spring 359 interposed between the arm 356 and the support member 358 serves to push up the arm so as to bring the slitter 355 into contact with the slitting roller 352, the force of said spring being adjustable by a screw 360. A screw 361 at the distal end of the arm 356 acts against the force of the spring 359 to set a range in which the arm is allowed to swing. In addition, the shaft 357 is supported by the frame 101.

Figure 15:
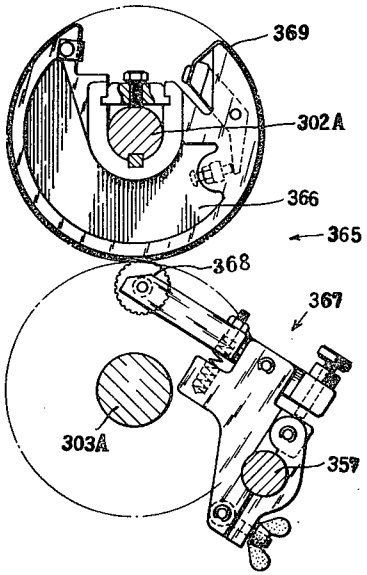
FIG. 15 is a front view of a secondary printing couple with a perforator.

FIG. 15 shows perforating means 365 provided in the secondary printing couple 301 for perforating.

The perforating means 365 consists of a perforating roller 366 mounted on the master cylinder shaft 302A, and a perforating assembly 367. Thus, the slitter 355 of the slitting means 351 is replaced by a perforater 368 and the slitting anvil 354 by a perforating anvil 369, and the rest of the construction is the same as in the slitting means 351.

By providing the secondary printing couple 301 with the slitting means 351 or perforating means 365, as described above, it is possible to slit or perforate paper which has been offset-printed.

In addition, two or more sets of slitting means 351 or perforating means 365 may be attached to the secondary printing couple 301 or both means 351 and 365 may be used at the same time.

Figure 16:
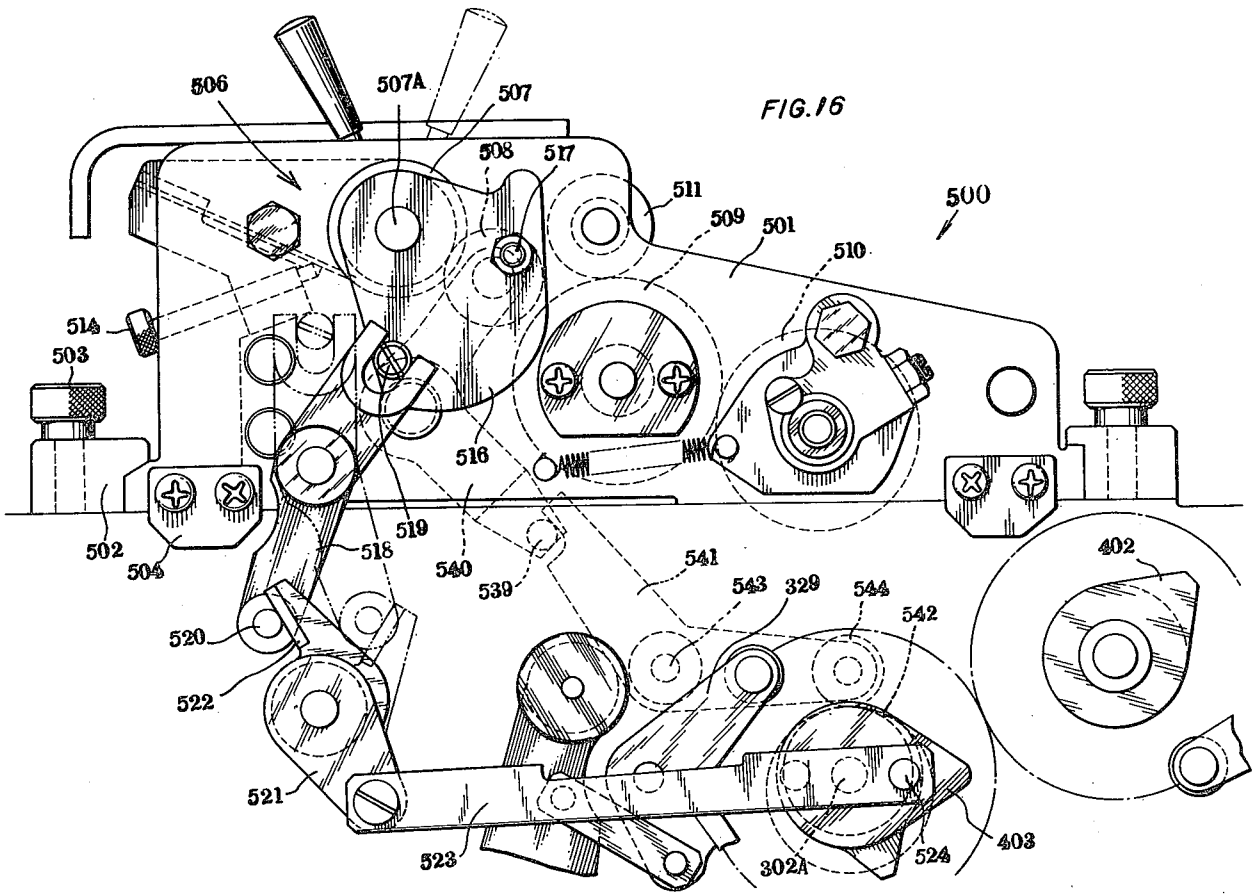
FIG. 16 is a front view to be used for explanation of the inking mechanism.
Figure 17:
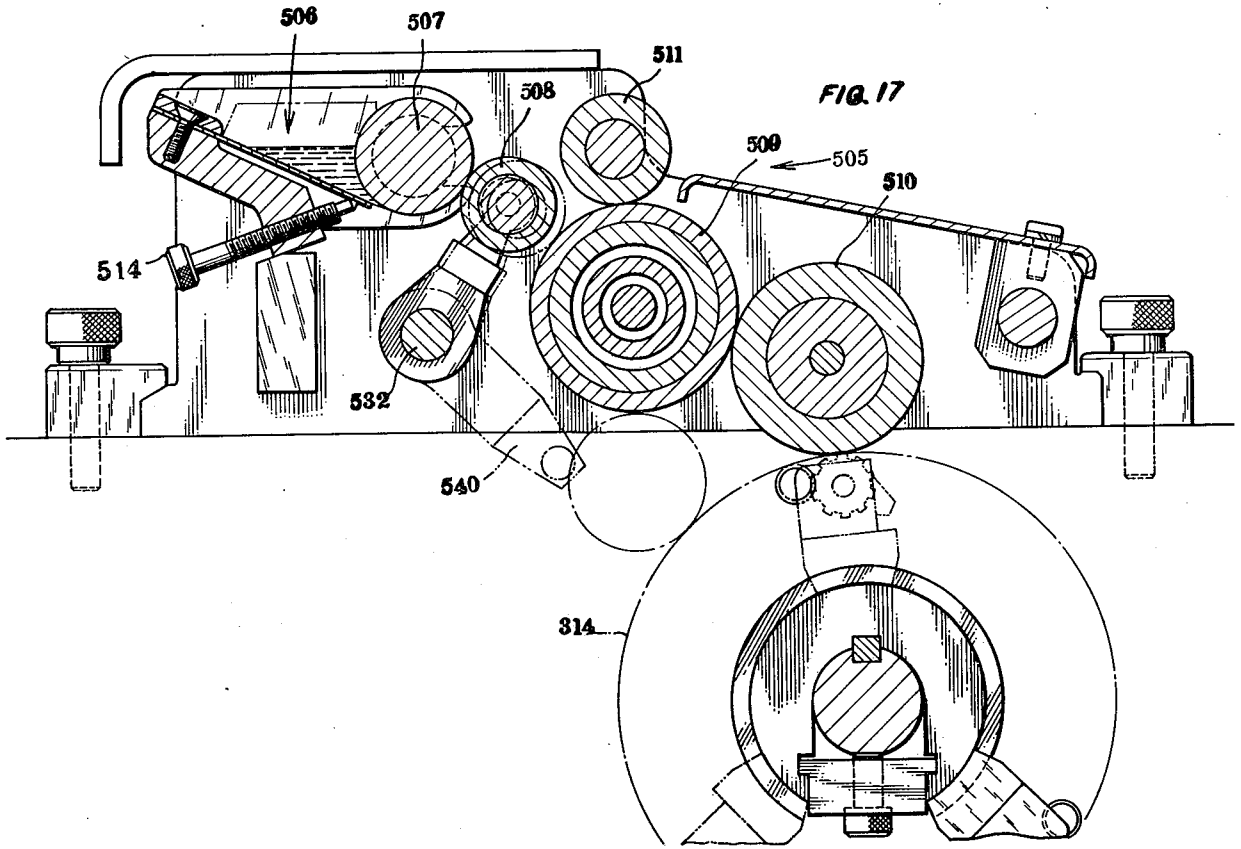
FIG. 17 is a sectional view showing the internal construction of the inking mechanism.
Figure 18:
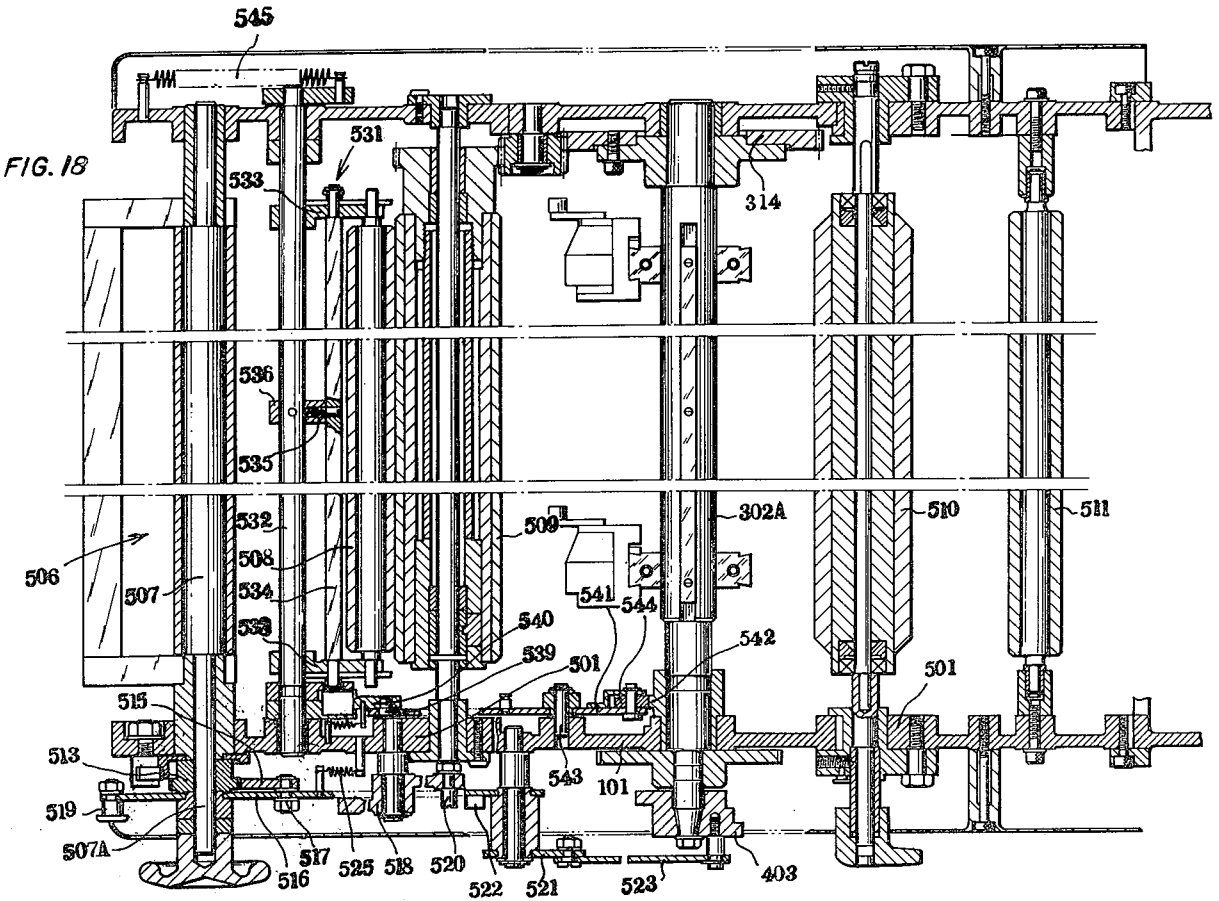
FIG. 18 is a detailed developed view to be used for explanation of the internal construction of the inking mechanism and a construction for driving an ink roller assembly.
Figures 20, 21:
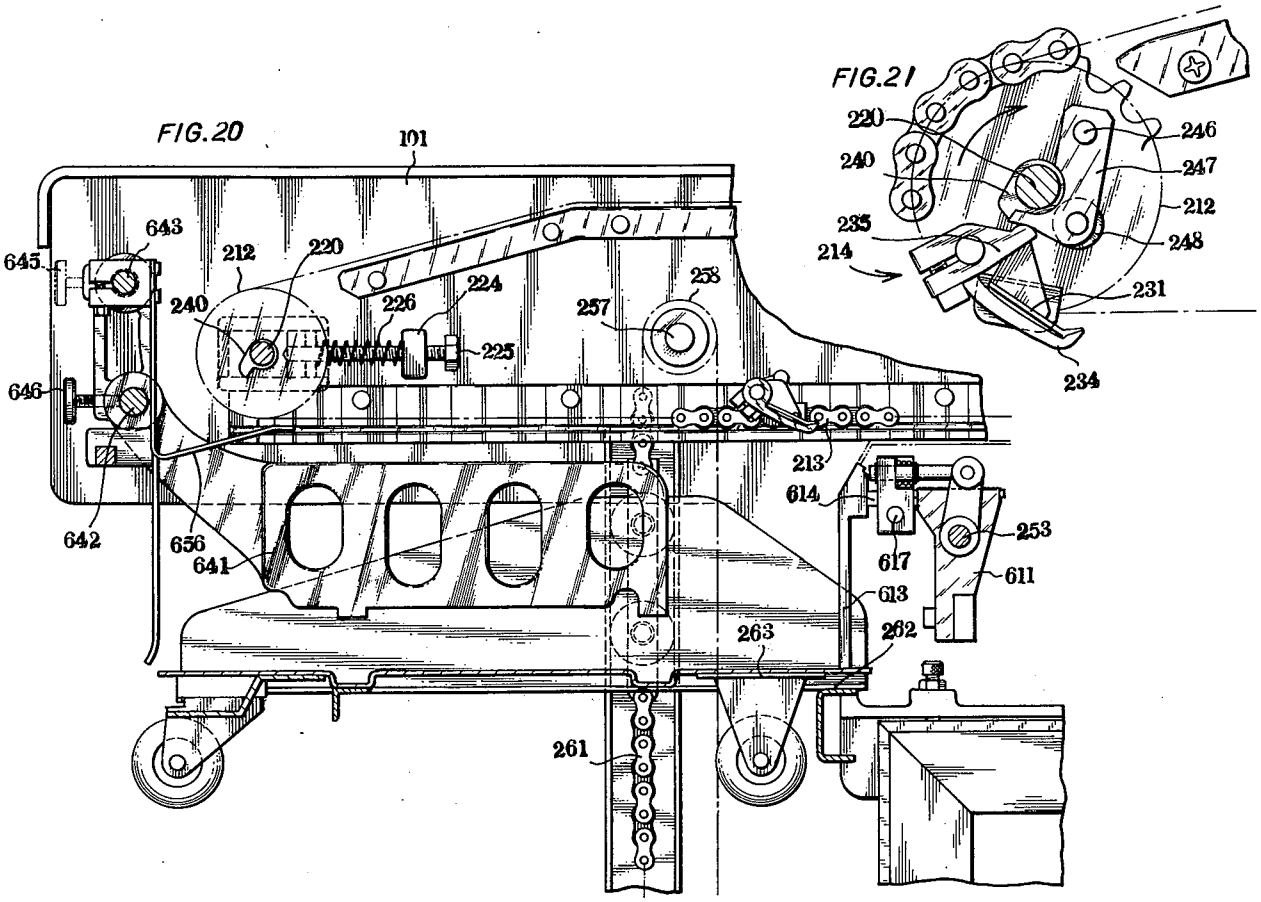
FIG. 20 is a front view with the frame removed to show the delivery mechanism and part of a transverse paper attitude correcting mechanism.
FIG. 21 is an explanatory view showing a paper ejecting cam for opening and closing the grip means.

FIGS. 16–18 show an inking mechanism 500 for feeding ink to the secondary printing couple 301. An inking frame 501 which supports the ink roller assembly 505 of the inking mechanism 500 is slidably mounted on the frame 101. That is, the frame 501 and its internal construction are arranged so that the mechanism 500 may be retracted from the position where it feeds ink to the secondary pinting couple 301 so as to allow easily exchange and inspection of the components of each cylinder of the secondary printing couple.

The frame 501 is secured to the frame 101 by attachments 502 and bolts 503. Designated at 504 are guide plates attached to the front and rear of the frame 501 to serve as guides for the latter.

The ink roller assembly 505 comprises an ink fountain 506, a fountain roller 507, a ductor roller 508, a distributing roller 509, a form roller 510 and a rider roller 511. As is known in the art, the ink fountain 506 is arranged to adjust the amount of ink by an adjusting screw 514. The ink taken out by the fountain roller 507 is applied to the form roller 510 through the ductor roller 508 and distributing roller 509. This distributing roller is vibrating by known manner.

The end of the roller shaft 507A of the fountain roller 507 has a ratchet wheel 513 fixed thereon and a drive plate 516 fitted thereover. Designated at 515 is a ratchet (not shown) meshing with the teeth of the ratchet wheel 513. The ratchet 515 and plate 516 are connected together by a pin 517. Designated at 518 is a bell crank pivotally supported by the inking frame 501 and detachably connected at one end thereof to a pin 519 set in the plate 516, the other end of said bell crank having a contact pin 520 set therein. The pin 520 on the bell crank 518 is in contact with a contact plate 522 provided at one end of a drive crank 521, so that pin 520 will be pushed when the drive crank 521 swings.

The drive crank 521 is pivotally supported by the frame 101 and its end opposite to the one provided with the plate 522 is connected to a link 523, which in turn is connected through a pivot 524 to a cam 403 provided on the shaft 302A so as to swing the drive crank 521 as the cam 403 is rotated. The swing motion of the crank 521 is transmitted to the drive plate 516 through the bell crank 518 to rotate the fountain roller 507 for taking out ink. In addition, as is apparent from the fact that the contact pin 520 contacts the contact plate 522, the latter can only push the pin 520 but cannot pull it. Thus, the return motion of the bell crank 518, i.e., the reverse rotation of the drive plate 516 is effected by a spring 525 provided between said plate 516 and the inking frame 501.

The ductor roller 508 is supported by a holder assembly 531, which comprises a drive shaft 532 rotatably supported by the inking frame 501, a pair of roller brackets 533 fitted over said shaft 532 and supporting opposite ends of a ductor roller 508, and a flat bar 534 connected at opposite ends thereof to the pair of roller brackets 533 and disposed between the roller 508 and the shaft 532, said flat bar 534 being connected to a member 536 fixed to the shaft 532 by a pivot pin 535.

Fixed to the end of the drive shaft 532 is a lever 540 having a small roller 539 at the front end thereof. The frame 101 supports a bell crank 541 through a pin 543, one end of said bell crank 541 being in contact with a roller 539, the other end having a cam follower 544 set therein. The cam follower 544 is in contact with a cam 542 fixed on the shaft 302A, so that the bell crank 541 swings as the cam 542 is rotated. The swing motion of the bell crank 541 is transmitted to the lever 540 through the roller 539 to swing the ductor roller 508 between the rollers 507 and 509.

The bell crank 541 can only push the lever 540 in one direction, the pull in the opposite direction being effected by a spring 545 provided the other side of said drive shaft 532.

The connection between the bell crank 518 and drive crank 521 and between the lever 540 and bell crank 541 is not by a pivot but by contact therebetween for transmission of power. This arrangement, as described above, permits the movement of the inking mechanism 500 from the predetermined position where it feeds ink to the secondary printing couple 301. Further, it also permits the easy exchange of the members of the secondary printing couple and the mounting and dismounting of the slitting means and perforating means.

The delivery mechanism 200 comprises a mechanism 201 for receiving paper from the primary printing couple 59 and transferring it to the delivery table, and a mechanism 202 for lowering the delivery table. The transfer mechanism 201 is shown in FIGS. 2, 8, 9 and 19–22 and includes a pair of front sprockets 209A and 209B, a pair of back sprockets 212, a pair of endless chains 213 entrained around said front and back sprockets, and gripping means 214.

The pair of front sprockets 209 are fixed on the sprocket shaft 210, one sprocket 209A having fixed thereon a drive gear 211 meshing with the gear 80 on the impression cylinder 57.

The front sprocket shaft 210 is rotatably supported on an arm 217 attached to the inner surface of the delivery frame 101 by bolts 216 and extending therefrom the intermediate portion of the shaft 210 being provided with number of paper guide wheels 218.

The back sprockets 212 are rotatably supported on a back sprocket shaft 220 and have half the diameter of the front sprockets 209, said shaft 220 being supported by the frame 101 through a tension adjusting assembly 221. Both ends of the shaft 220 are inserted in the shaft pilot blocks 222 of the tension adjusting assembly 221. The shaft pilot blocks 222 are slidably disposed within guide members 223 fixed to the frame 101, and the front end of a bolts 225 axially slidably extending through a projection 224 of the frame 101 are threadedly inserted in such blocks 222. The bolts 225 have springs 226 fitted thereover and by turning the bolts 225 the tension can be adjusted. Designated at 227 are screws for preventing the rotation of the shaft 220 with the blocks.

Figure 22:
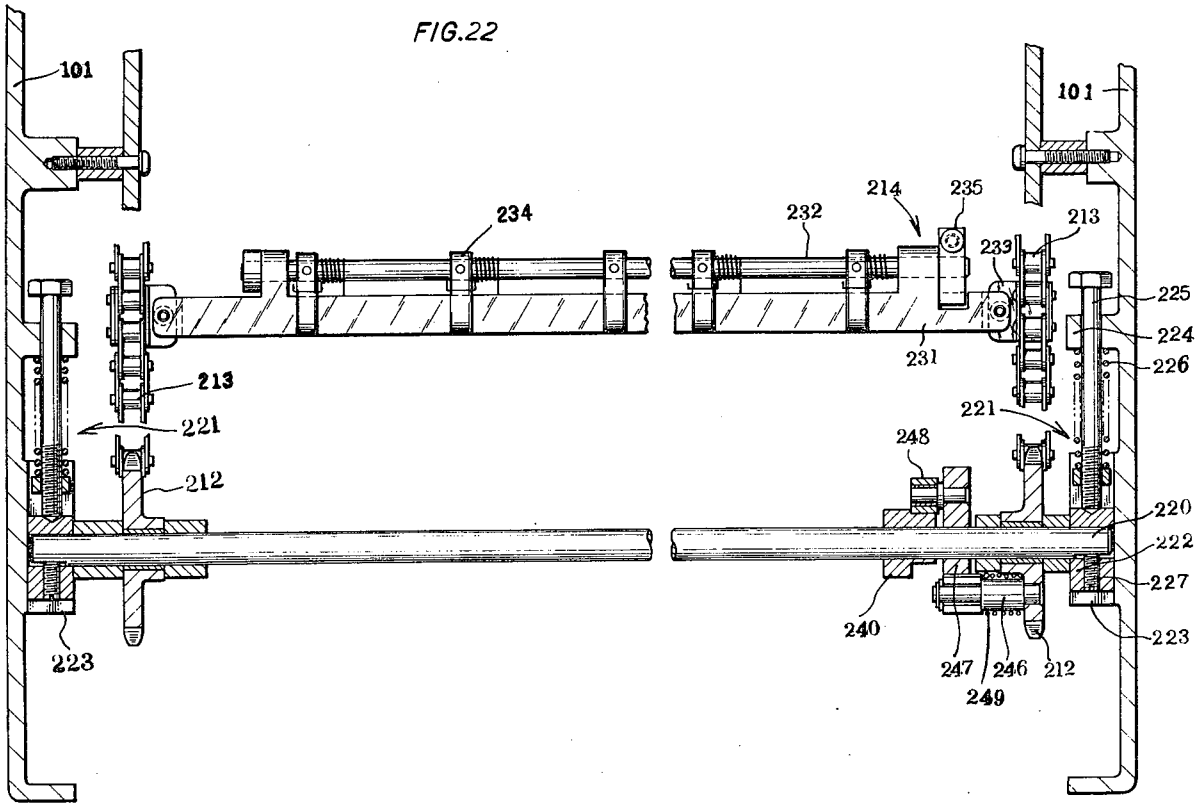
FIG. 22 is a sectional view showing the rear portion of a transfer mechanism.

The gripping means 214, whose plan views are shown in FIGS. 8 and 22, comprises a gripper bar 231 secured between the both endless chains 213 through attachments 233, a plurality of gripper fingers 234 provided on said gripper bar 231 and adapted to grip the front end of paper between them and the gripper bar, and a gripper lever 235 provided at the end of the gripper shaft 232 and adapted to open and close the gripper fingers. A plurality of gripping means fitted to the chain at such a pitch as corresponding to the circumferential length of the impression cylinder are circulated.

Cams for opening the gripper fingers 234 of the gripping means 214 are disposed adjacent the front sprocket wheel 209B and back sprocket wheel 212, respectively. A cam 238 for opening the gripping means 214 for receiving paper having a primary print made thereon is fixed to the support arm 217 by bolts 239 adjacent the front sprocket wheel 209B, while a release cam 240 for opening the gripping means 214 so as to drop paper having a secondary print made thereon onto the delivery table is fixed on the shaft 220 adjacent the sprocket wheel 212.

The sprocket wheel 209B is provided with a swing arm 241 in the form of a bell crank carrying at one end thereof a cam follower 242 in contact with a receiving cam 238, and at the other end a spring 243 fixed between it and the sprocket wheel 209B for urging the cam follower 242 against the cam 238.

In the gripping means of the conventional apparatus, the front end of the gripper lever 235 is provided with a cam follower in contact with a gripper opening and closing cam, which arrangement makes it necessary to provide a wider space between gripper bar 231 and the gripper shaft 232. In contrast, in the present apparatus, since the cam follower 242 is attached to the sprocket wheel 209B, the distance between the bar and shaft can be made shorter and hence the range in which secondary printing is allowed can be made longer.

The gripping means 214 and sprocket wheel 209B are so timed that the front end of the gripper lever 235 may contact the back of the swing arm 241. Thus, as the cam follower 242 rolls on the cam face of the receiving cam 283 to swing the swing arm 241, the gripper lever 235 also swings to open the gripper fingers, so that the paper gripped by the impression cylinder 57 is received and gripped by the fingers as the latter are closed. At the same time grippers of the impression cylinder release the paper. In addition, the gripper means for the impression cylinder 57 is known and therefore a description thereof is omitted.

One end of a swing arm 247 for paper release is pivotally supported by the sprocket wheel 212 through a short shaft 246, and a cam follower 248 disposed at the center of the swing arm contacts a release cam 240. The force with which the cam follower 248 is urged against the cam 240 is given by a spring 249.

The relationship between the sprocket wheel 212 and the gripping means 214 is such that the distance between the gripping means is twice the circumference of the pitch circle of the sprocket wheel 212, and the timing is such that the front end of the gripper lever 235 is brought into contact with the back of the swing arm 247 each time the swing arm 247 makes two complete revolutions. Thus, as the cam follower 248 contacts the cam 240 to swing the swing arm 247 aroung the axis of the short shaft 246, the gripper lever 235 also swings to open the gripper fingers, thereby releasing the gripped paper.

Since the diameter of the back sprocket wheel 212 is reduced to half that of the front sprocket wheel 209, the rear portion of the delivery mechanism can be made smaller and hence the size of the apparatus itself can be made smaller.

The mechanism 202 for lowering the delivery table is adapted to receive power from other than that for the transfer mechanism 201, as shown in FIGS. 2, 9, 11, 20, and 23–25.

A cam lever 251 pivotally supported by the frame 101 through a shaft 253 is disposed adjacent the impression cylinder 303 of the secondary printing couple 301. A cam follower 252 at one end of this cam lever is in contact with a drive cam 254 fixed to a bearing holder 311B, so that the rotation of the cam 254 causes the cam lever 251 to swing.

The shaft 253 on which the cam lever 251 is mounted also has a lever 255 fixed thereon. The swing motion of said lever 255 is transmitted as an intermittent rotative motion to an upper shaft 257 through ratchet means 256. A pair of upper sprocket wheels 258 are fixed on the upper shaft 257, and a pair of lower sprocket wheels 260 are provided on a lower shaft 259, with a pair of endless chains 261 entrained around these upper and lower sprocket wheels. The lower sprocket wheels 260 are shown in FIG. 2 and the lower shaft 259 is fixed under base cover panel 264.

The delivery table 262 is attached to the pair of endless chain 261 and carries a dolly 263 thereon onto which sheets of paper after being printed will stack up.

The above-mentioned intermittent rotation of the upper shaft 257 causes the endless chains 261 to be intermittently driven and hence the delivery table 262 to be intermittently lowered.

The lever 255 is connected to a link 266, which in turn is connected to a ratchet drive link 267, whose one end is connected to a drive pawl bracket 268, said bracket is swung on the shaft 269, which has fixed thereon a bevel gear 271 provided with a ratchet wheel 270, with a delivery pile crank handle 272 attached to the end of the shaft. The shaft 269 is supported by a plate 280 fixed to the frame 101 and by a worm bracket 273 attached to said plate. The worm bracket 273 rotatably supports a worm 274 meshing with a worm gear 275 mounted on uppr shaft 257. Further, the shaft provided with the worm 274 is also provided with a bevel gear 276 meshing with said bevel gear 271.

The upper portion of the drive pawl bracket 268 is provided with a drive pawl 277 capable of meshing with the ratchet wheel 270. Thus, as the bracket 268 swings, the drive pawl 277 meshes with the ratchet wheel 270 and turns it in required angular increments. Designated at 278 is a control lever for adjusting the rotative angle of the ratchet wheel 270, and 279 is a detent pawl for preventing the reverse rotation.

The swing motion of the bracket 268 is transmitted to the shaft 257 through the ratchet wheel 270 pair of bevel gears 271, 276,worm 274, and worm gear 275 to turn the upper sprockets 258 through the required angle. The upper sprocket wheels 258 turn the endless chains through an angle corresponding to the thickness of the printing paper.

The mechanism 600 for correcting the attitude of sheets of secondarily printed sheets of paper to be stacked on the delivery table 262 comprises a longitudinal paper attitude correcting mechanism 601 for pushing paper from the back to correct the longitudinal attitude thereof, and a transverse paper attitude correcting mechanism 602 for pushing paper from the sides to correct the transverse attitude thereof, both mechanisms receiving power from the swing motion of the cam lever 251.

Figure 27:
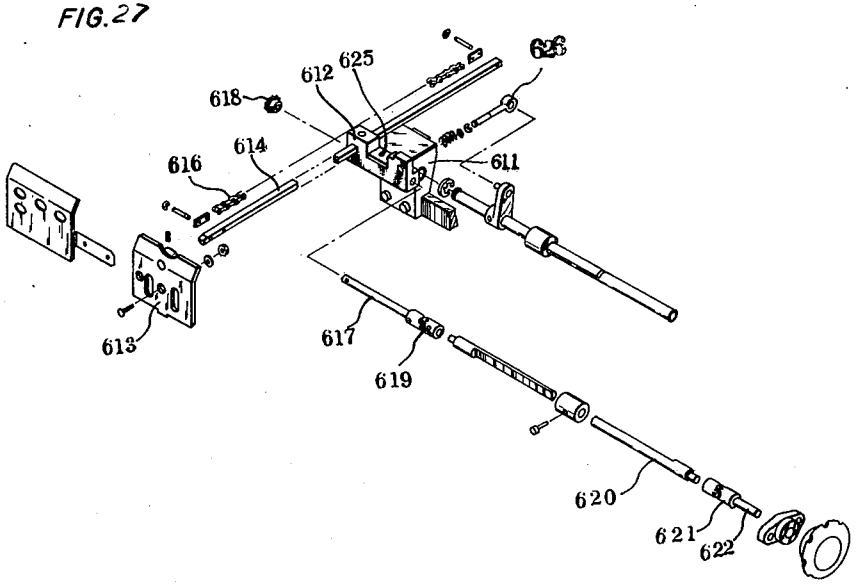
FIG. 27 is an exploded explanatory view of the longitudinal paper attitude correcting mechanism.
Figure 23:
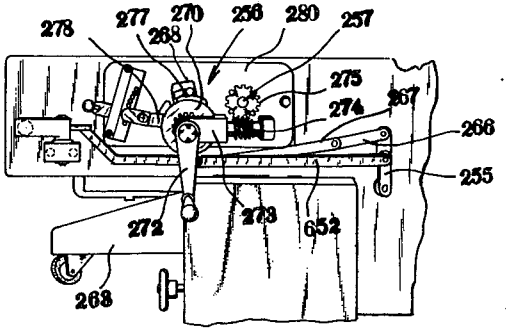
FIG. 23 is a front view of ratchet means for the receiving stacker.
Figure 24:
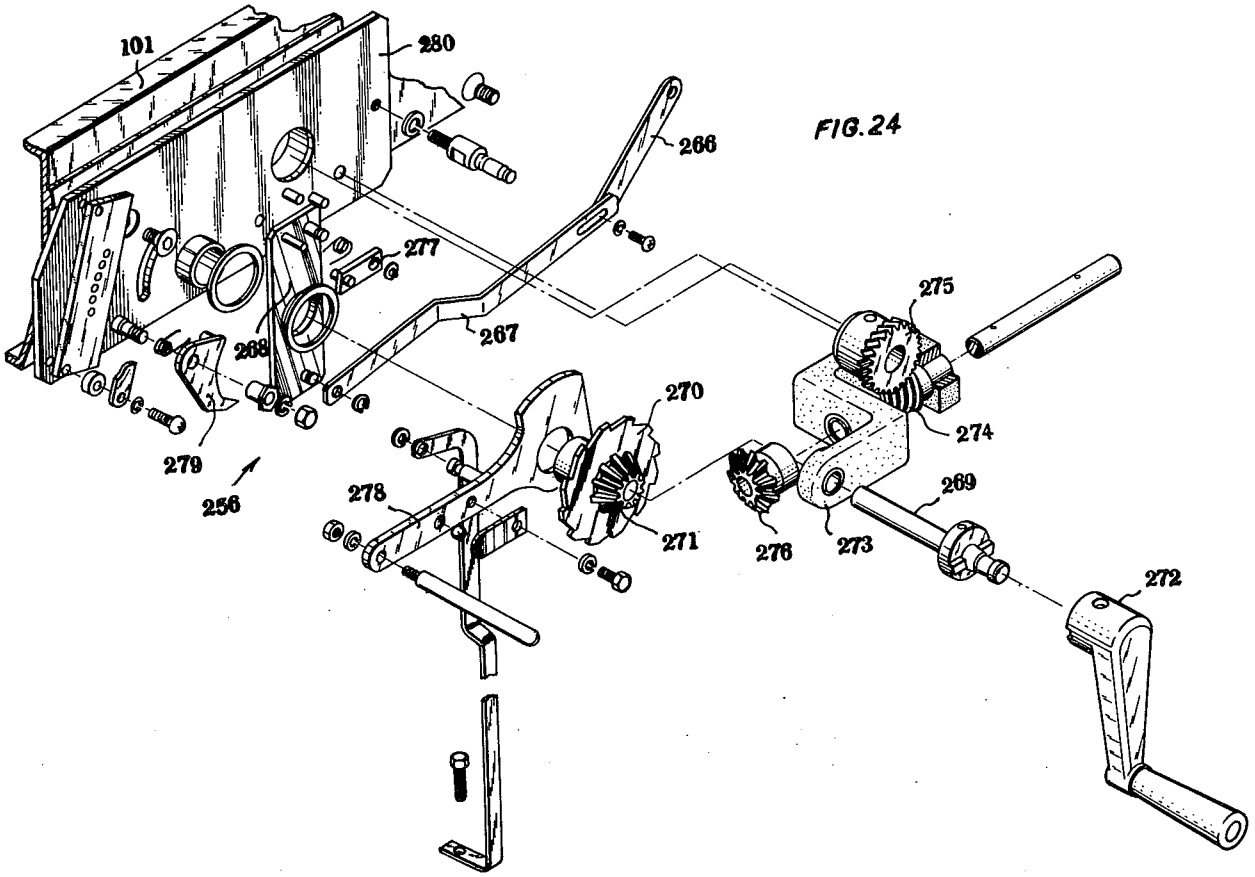
FIG. 24 is an exploded explanatory view of the ratchet means.
Figure 25:
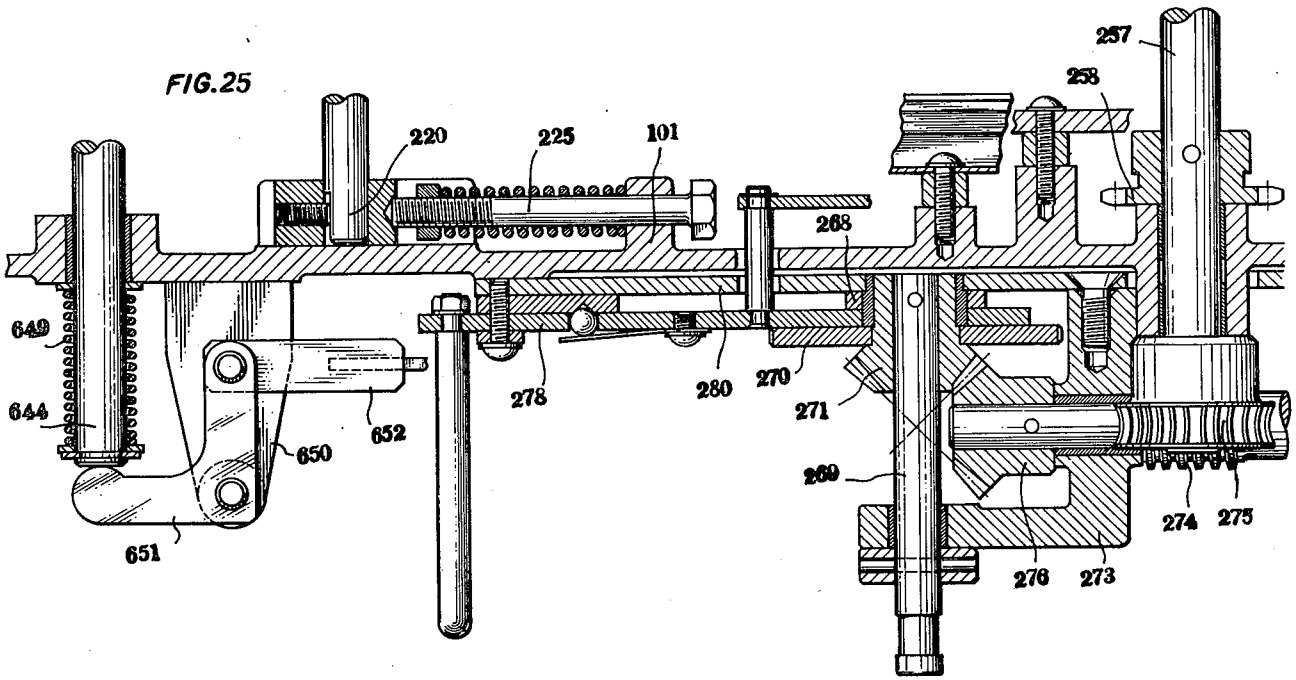
FIG. 25 is a detailed sectional view of the ratchet means and part of the transverse paper attitude correcting mechanism shown in section.
Figure 26:
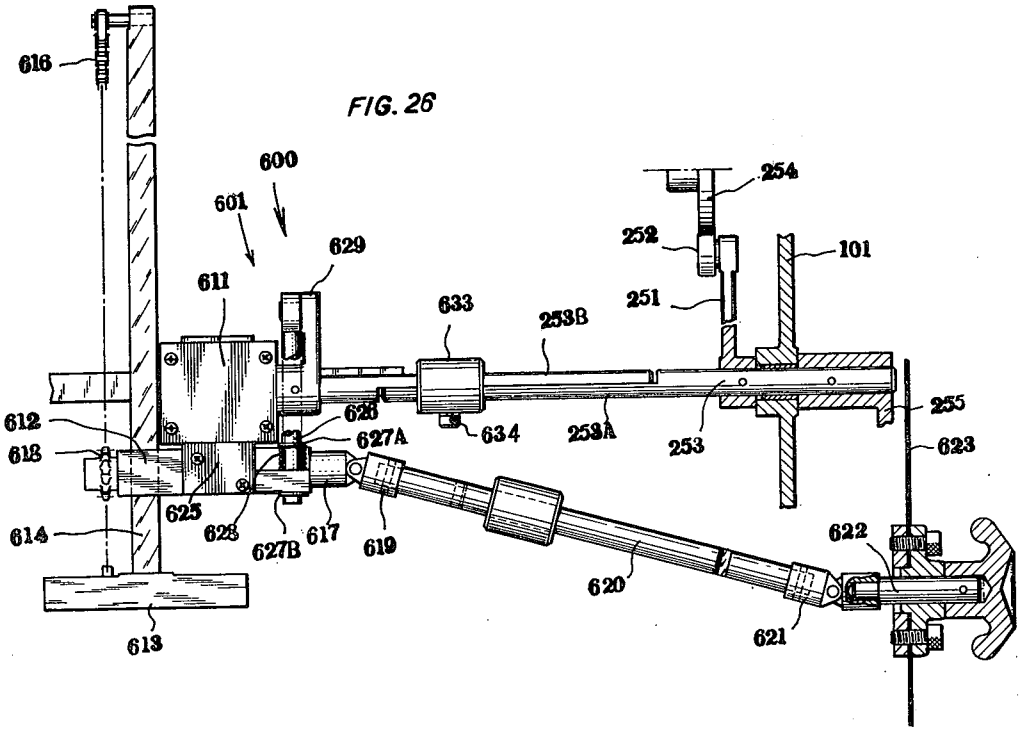
FIG. 26 is a plan view showing the principal portion of the longitudinal paper attitude correcting mechanism.
Figure 28:
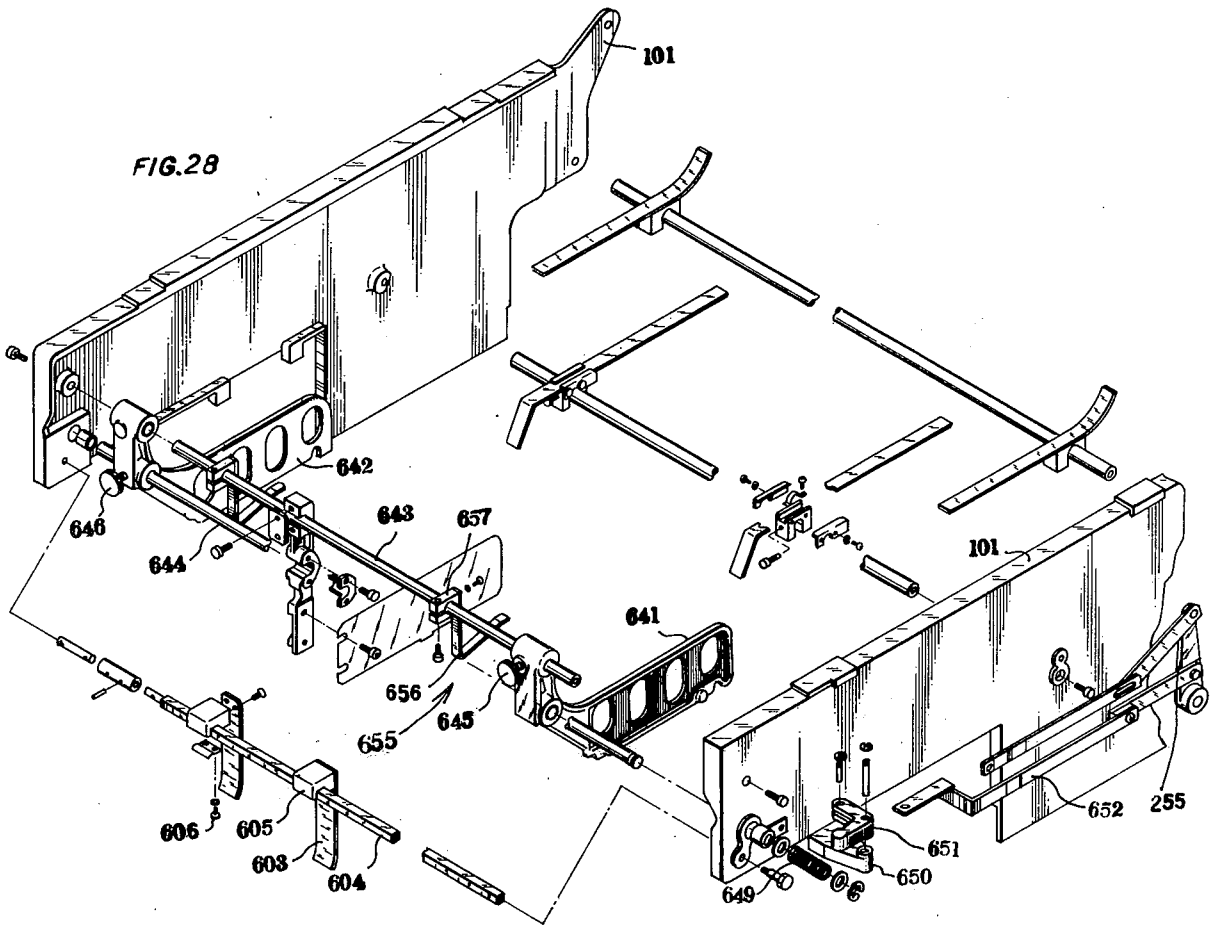
FIG. 28 is an exploded explanatory view of the transverse paper attitude correcting mechanism.

FIGS. 26 and 27 show the longitudinal paper attitude correcting mechanism 601 adapted to push paper from the back. A guide plate 603 for truing up the front edges of sheets of paper is shown in FIGS. 28 and 2 and it is attached to a guide block 605 fitted over a guide supporter 604 supported at its both ends by the frame 101. The position of the guide block 605 along the guide supporter 604 can be adjusted.

A shaft 253 adapted to be rotated by the swing motion of the cam lever 251 is a drive shaft for the longitudinal paper attitude correcting mechanism 601 and is provided at its front end with a back guide slide bracket 611. A guide slider 625 is slidably positioned on the bracket 611 and a guide bracket 612 is fixed on said guide slider 625. A guide shaft 614 provided at the front end thereof with a back guide 613 slidably extends through and is supported by the guide bracket 612.

Designated at 616 is a chain extending beside the guide shaft 614 and meshing with a sprocket wheel 618 mounted on a shaft 617 rotatably supported in the guide bracket 612. The shaft 617 is connected to a shaft 620 through a universal coupling 619, while said shaft 620 is connected to a short shaft 622 through a universal coupling 621. The short shaft 622 is rotatably supported by a cover 623 fixed to the frame 101 and the rotation of the shaft 622 drives the sprocket wheel 618, causing the guide shaft 614 to be slid by the chain with respect to the guide bracket 612, whereby the distance between the guide plate 603 and the back guide 613 can be adjusted to the size of the paper.

One end of a pusher bar 626 is slidable with respect to the guide bracket 612 and prevented from slipping off by stop rings 627A and 627B. It extends through and is connected to the guide bracket 612 so as to elastically transmit its axial movement through a spring 628. The other end of the pusher bar 626 is pivotally connected to an arm 629 fixed on the shaft 253.

When the shaft 253 is rotated to swing the arm 629, the guide bracket 612 is elastically moved back and forth through the pusher bar 626, causing the back guide 613 to correct the longitudinal attitude of the paper.

As shown in FIG. 26, the shaft 253 is arranged so that its length can be adjusted. The shaft 253 consists of shaft members 253A and 253B each having a semi-circular cross-section over a fixed length from one end thereof, with the shaft members put together along their flat portions to form a single shaft, and a cylindrical fixing member 633 is fitted over the junction and fixed in position by a bolt 634. When it is desired to change the length of the shaft, this may be achieved by loosening the bolt 634, axially moving the shaft members 253A and 253B in opposite directions away from each other until the desired length is obtained, and re-tightening the bolt so that they will act as a single shaft. The shaft 620 is arranged in the same manner as the shaft 253 so that its length can be adjusted.

The reason for arranging the two shafts 253, 620 so that their length can be adjusted as described above is that sheets of paper to be printed may vary in size and that it is desirable that the back guide 613 be positioned on the centerline of a sheet of paper. Thus, by adjusting the length of the shafts, the position of the back guide 613 can be adjusted.

FIG. 28 shows the transverse paper attitude correcting mechanism 602 including pile guides 641 and 642. One pile guide 641 is fixed while the other pile guide 642 is movable to true up the right and left edges of sheets of paper.

The two pile guides are supported by an outer spreader 643 fixed to the frame 101 and by an axially slidable jogger shaft 644 which is parallel to said spreader the pile guide 641 being fixed to the outer spreader 643 by a screw 645, the pile guide 642 being fixed to the jogger shaft 644 by a screw 646.

One end of the jogger shaft 644 projects through the frame 101 to receive a spring 649 thereon. A member 650 is a lever bracket fixed to the frame 101 and this bracket 650 pivotally supports an operating lever 651, the swing motion of which axially pushes the jogger shaft 644, while the action of the spring 649 pulls back the latter. In this way, the right and left edges of sheets of paper are trued up.

Pivotally connected to the operating lever 651 is a link 652, the other end of which is connected to the central portion of a lever 255, whereby the swing motion of the lever 255 is transmitted to the lever 651.

The outer spreader 643 is provided with a delivery stripper assembly 655, which comprises stripper finger 656 and stripper brackets 657 and serves to strip the paper gripped by the gripping means 214 of the transfer mechanism 201 after the gripping means is released by the release cam 240.

What is claimed is:

1. An apparatus for effecting secondary printing in the course of paper delivery in addition to primary printing achieved within the body of an offset printing machine; the offset printing machine comprising at least a paper feed unit adapted to feed paper sheets one by one ahead from a paper table rising upwardly with a number of paper sheets mounted thereon and a unit for printing papers comprising a plate cylinder having a sheet of original plate thereon a blanket cylinder adapted to rotate in contact with said plate cylinder, an impression cylinder provided on an eccentric shaft, a detection mechanism for detecting the paper feed and an inking mechanism, the operation of said printing unit comprising actuation of said detection mechanism by a paper fed from said paper feed unit, resulting in the rotation of said eccentric shaft to bring said impression cylinder in contact with said blanket cylinder and thus producing printing pressure permitting printing on said paper sheet; the apparatus for effecting secondary printing being adapted to be removably connected by means of clamping members to said offset printing machine and comprising:

a delivery mechanism adapted to grippingly receive by a gripping means the paper printed by the said printing unit from said blanket cylinder to transfer the same onto said delivery table and to lower said delivery table with stacking paper sheets thereon;

a mechanism provided with a printing couple for performing secondary printing on the paper transferred by said delivery mechanism;

a mechanism for applying printing pressure from the time when the paper printed by said printing unit approaches said secondary printing couple; and a mechanism for arranging paper sheets on said delivery table with respect to lateral and longitudinal directions thereof, the apparatus for effecting secondary printing being further adapted to operate each of said mechanisms in interlocked connection with the operation of said printing couple of said printing unit of said offset printing machine.

2. An apparatus as claimed in claim 1, in which the secondary printing couple includes an impression cylinder and said mechanism for applying printing pressure comprises a printing pressure means adapted to apply and stop applying printing pressure for secondary printing on the paper through the operation of said impression cylinder of said secondary printing couple and a means adapted to transmit paper detection signals from said detection mechanism to said printing pressure means with a delay corresponding to the time required for the paper to be transferred from said primary printing couple to said secondary printing couple.

3. An apparatus as claimed in claim 2, in which said impression cylinder for secondary printing is rotatably fittedly mounted on an eccentric shaft, a pivotal member provided with a worm screw is adjustably fittedly mounted on the end of said eccentric shaft, said worm screw being in engagement with a sector gear fixed on the end of said eccentric shaft, said pivotal member being connected to one end of a pivoting lever for pivoting said pivotal member and said pivoting lever being adapted to be pivoted by signals from said detection means, and printing pressure applied on said secondary printing couple is adjusted by turning said worm screw to change the position of engagement of said screw with said sector gear.

4. An apparatus as claimed in claim 2, in which a printing pressure lever adapted to be pivoted by a first cam provided on a supporting shaft of said blanket cylinder so as to apply printing pressure on said impression cylinder of primary printing unit is connected at one end through a link to the connection end of a first detent pawl the engagement end of which is positioned so as to be engageable with one end of a lever pivoted by a second cam so as to hold said lever in pivoted condition, said first detent pawl being connected through a link to a second detent pawl which is provided for holding in pressure application condition said printing pressure lever for applying printing pressure on said impression cylinder of said secondary printing couple, a third cam is provided on the shaft of a master cylinder for secondary printing so as to pivot said printing pressure lever for secondary printing, the pivotal movement of said printing pressure lever for primary printing is delayed by said second cam and transmitted by said third cam to said printing pressure lever for secondary printing to hold said lever in pressed condition, and said second cam is provided for transmitting signals from said first cam in sequence so that said third cam can be operated with a delay corresponding to the time required for the paper to be transferred from said primary printing couple to said secondary printing couple.

5. An apparatus as claimed in claim 4, in which said pivoting lever connected to said eccentric shaft of said impression cylinder of said secondary printing couple so as to rotate said eccentric cylinder is adapted to be held in printing pressure application condition by means of said detent pawl engaged with one end of said pivoting lever, and a release means is provided near said detent pawl so that the engagement end of said detent pawl is retreated from one end of said pivoting lever to release said pivoting lever from printing pressure application condition.

6. An apparatus as claimed in claim 1, in which said secondary printing couple comprises a spot printing cylinder removably mounted on a master cylinder shaft and an impression cylinder disposed in correspondence with said spot printing cylinder, and said impression cylinder and said spot printing cylinders are adapted to clear said gripping means of paper which periodically passes through said two cylinders.

7. An apparatus as claimed in claim 1, in which said secondary printing couple comprises at least one numbering unit removably mounted on a master cylinder and an impression cylinder disposed in correspondence with said numbering unit, a number exchange cam for exchanging the number of said numbering unit, and a means for displacing, after completion of secondary printing, said number exchange cam to the position of exchanging the number of said numbering unit in interlocked motion with said impression cylinder operated so as to apply printing pressure for secondary printing.

8. An apparatus as claimed in claim 7, in which at least a slitting roller is provided on a shaft on which said numbering unit of said secondary printing couple is mounted, said slitting roller having a diameter slightly smaller than that of a printing circle of said numbering unit and adapted not to be in contact with a form roller for inking said numbering unit, and below said slitting roller there is provided a slitter disposed against said slitting roller so as to cut the paper between said slitting roller and said slitter, said slitter being rotatably supported by the top end portion of an arm pivotally secured to a supporting member supported by the frame of said apparatus, between said arm and said supporting member a spring is provided for pressing said slitter against said slitting roller, said arm being provided with a screw for controlling the spring force applied onto said arm, said slitting roller is partly cut away at the periphery thereof so as to clear off the movement of said gripping means of said delivery mechanism, and a screw is provided on said arm for controlling the movement of said arm so as to prevent said slitter from being inserted into a cut-away portion of the periphery of said slitting roller when said cut-away portion comes to the position opposed to said slitter.

9. An apparatus as claimed in claim 7, in which at least an anivl roller is provided on a shaft on which said numbering unit of said secondary printing couple is mounted, said anvil roller having a diameter slightly smaller than that of a printing circle of said numbering unit and adapted not to be in contact with a form roller for inking said numbering unit, and below said anvil roller there is provided a perforating cutter disposed against said anvil roller so as to perforate the paper between said anvil roller and said perforating cutter, said perforating cutter being rotatably supported by the top end portion of an arm pivotally secured to a supporting member supported by the frame of said apparatus, between said arm and said supporting member a spring is provided for pressing said perforating cutter against said anvil roller said arm being provided with a screw for controlling the spring force applied onto said arm, said anvil roller is partly cut away at the periphery thereof so as to clear off the movement of said gripping means of said delivery mechanism, and a screw is provided on said arm for controlling the movement of said arm so as to prevent said perforating cutter from being inserted into a cut-away portion of the periphery of said anvil roller when said cut-away portion comes to the position opposed to said perforating cutter.

10. An apparatus as claimed in claim 7 including a number exchange lever engageable by said number exchange cam and a shaft on which said number exchange cam is mounted in contact with said number exchange lever being adapted to be pivoted through the pivotal movement of a bell crank which is pivoted by a cam provided at the end of said shaft on which said numbering unit is mounted, a detent pawl for holding said bell crank in the pivoted condition is connected at its end through a link with a printing pressure lever for applying pressure on said secondary printing impression cylinder, said detent pawl being brought into operative condition by the pivotal movement of said printing pressure lever and actuated by the pivotal movement of said bell crank effected by said cam to hold said number exchange cam against said number exchange lever, and a release means is provided near said detent pawl for releasing the top portion of said detent pawl from the position of holding said bell crank in pivotal movement so as to retreat said number exchange cam away from said number exchange lever.

11. An apparatus as claimed in claim 1, including an inking mechanism disposed above said secondary printing couple and adapted to supply a master cylinder with ink, the inking mechanism comprising an ink fountain, an ink fountain roller, a ductor roller, an ink distributing roller, vibrating roller, form roller, a frame supporting said fountain and all of said rollers, a first power transmission means adapted to change the rotation of a master cylinder for secondary printing into swinging movement to ratchet motion said ink fountain roller and a second power transmission means adapted to change the rotation of the shaft of said master cylinder into swinging movement so as to swing said ductor roller.

12. An apparatus as claimed in claim 11, in which said first power transmission means comprises a first swinging crank adapted to be swung through the swinging movement of a lever effected by a cam provided on the master cylinder shaft, and a second swinging crank rotatably connected to a member provided at the end of the ink fountain roller shaft and swingably supported by said inking frame, said first and second swinging cranks are arranged in contact with each other at one end thereof respectively and also detachable, while said second power transmission means comprises a cam provided on said master cylinder shaft, a third swinging crank adapted to be swung by the rotation of said cam and a supporting crank supporting at one end thereof a ductor roller and swingably supported by said inking frame, said third swinging crank and said supporting crank are arranged in contact with each other at one end thereof respectively and also detachable, said inking frame being removably mounted on the frame of said apparatus and said inking mechanism being adapted to be releasable from the position of supply of said master cylinder with ink.

13. An apparatus as claimed in claim 1, in which said delivery mechanism comprises a transfer mechanism for passing the paper received from said impression cylinder through said secondary printing couple and mounting the same onto said delivery table, and a mechanism for lowering said delivery table with stacking the paper thereon to such a distance as corresponding to the thickness of the paper, and a transfer mechanism comprises a pair of driving sprocket wheels provided on a shaft to be driven by said primary printing impression cylinder, a pair of driven sprocket wheels disposed in the rear portion of said apparatus and having a diameter of half the diameter of said driving sprocket wheels, a pair of endless chains stretched over said sprocket wheels and a gripping means adapted to be moved together with said chains, said secondary printing couple including a secondary printing impression cylinder and said lowering mechanism comprises a swinging lever to be swung by a cam provided on the shaft of said secondary printing impression cylinder, a ratchet means for changing the swinging movement of said swinging lever into a required amount of angular displacement of a shaft, a pair of sprocket wheels provided on said shaft adapted to be pivoted by a required angle by means of said ratchet means, another pair of sprocket wheels disposed below said pair of sprocket wheels, a pair of endless chains stretched over said two pairs of sprocket wheels and a delivery table engaged at both ends thereof with said endless chains so as to be raised and lowered together with said chains and adapted to be provided with a dolly mounted thereon, said delivery table being raised and lowered by manually reversing said pair of sprocket wheels provided on said shaft.

14. An apparatus as claimed in claim 13, in which said gripping means for receiving the paper from said impression cylinder of said primary printing couple and transferring the same to the position where the paper is released from the gripping means comprises a gripper bar engaged at both ends thereof with a pair of endless chains, a gripper shaft rotatably supported by said gripper bar, a plurality of gripper fingers provided on said gripper shaft and adapted to holding the top edge of the paper against said gripper bar and a gripper lever provided on the end of said gripper shaft and adapted to open and close said gripper fingers, and said driving sprocket wheels are provided with a swinging arm adapted to be swung by means of a cam provided on a member supporting said sprocket wheels and to pivot said gripper lever to open and close said gripper fingers so as to grip the paper primarily printed, while said driven sprocket wheels are provided with a swinging arm adapted to be swung by means of a cam provided on a member supporting said sprocket and to pivot said gripper lever to open and close said gripper fingers so as to stack the paper transferred onto said delivery table.

15. An apparatus as claimed in claim 1, in which said paper arranging mechanism comprises a longitudinal arrangement mechanism for arranging the paper with respect to the longitudinal direction thereof against a fixed plate disposed behind by longitudinally swinging a rod provided at the top end with an end jogger plate and a lateral arrangement mechanism for arranging the paper with respect to the lateral direction thereof by sliding an axially slidable shaft by means of a fixed pile guide and another pile guide fixed on said slidable shaft, said two arrangement mechanisms being driven through a power transmission means by a swinging lever to be swung by a cam provided on the shaft of said secondary printing impression cylinder.

16. An apparatus as claimed in claim 15, in which said longitudinal arrangement mechanism comprises a pivot for fixing a swinging lever as the center of the swinging movement of said lever, a gear block mounted on said pivot, a rod longitudinally slidable provided on said gear block and having an end jogger plate at the top end thereof, a chain stretched between the top and terminating ends of said rod, a sprocket wheel provided on the output shaft of said gear block and engaged with said chain and a control shaft connected to the input shaft of said gear block and adapted to slide said rod in the longitudinal direction though the rotation of said control shaft, said pivot and said control shaft comprises a shaft respectively formed by combining with clamp members a certain length of two halves of a shaft arranged in opposed condition and adapted to laterally adjust said rod by changing the lengths of said pivot and said control shaft.

17. An apparatus as claimed in claim 1, in which a pair of driving sprocket wheels for driving said transfer mechanism of said delivery mechanism are provided on the entrance side of the frame of said secondary printing apparatus, on a shaft on which said driving sprocket wheels are mounted there are fixed a gear engaged with another gear supported by an eccentric shaft of the impression cylinder of the offset printing machine, said latter gear being adapted to drive said secondary printing couple by power transmitted from a gear fixed on said driving sprocket wheel shaft, the secondary printing couple including a secondary printing impression cylinder mounted on an eccentric shaft, a drive cam is provided on said eccentric shaft of said secondary printing impression cylinder, a drive lever swung through the rotation of said cam is provided beside said drive cam, a ratchet means for lowering said delivery table every time the paper is stacked thereon is driven by a drive lever, a slidable shaft provided with a pile guide of a lateral paper arrangement mechanism is axially slidable by the swinging movement of said drive lever, a rod provided with an end jogger plate of a longitudinal arrangement mechanism is longitudinally slidable through the rotation of a shaft supporting said drive lever, the rotation of a ink fountain roller of said inking mechanism and the swinging movement of a ductor roller are effected by two cams provided on a master cylinder shaft driven by a gear provided on the shaft of said secondary printing impression cylinder, printing pressure is applied on said secondary printing impression cylinder by a cam provided on said master cyinder shaft and another cam provided on a shaft driven through the rotation of said master cylinder shaft, and power for driving all of said mechanisms is obtained from the rotation of a gear provided on said driving sprocket wheel shaft.

* * * * *